US009523929B2

(12) United States Patent
Nakamura et al.

(10) Patent No.: US 9,523,929 B2
(45) Date of Patent: Dec. 20, 2016

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Nobuhiro Nakamura, Numazu (JP); Atsushi Fujii, Yokohama (JP); Michiyo Sekiya, Atami (JP); Yota Ito, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/571,689

(22) Filed: Dec. 16, 2014

(65) Prior Publication Data

US 2015/0185638 A1 Jul. 2, 2015

(30) Foreign Application Priority Data

Dec. 26, 2013 (JP) ..... 2013-270563
Dec. 5, 2014 (JP) ..... 2014-247192

(51) Int. Cl.
*G03G 5/14* (2006.01)
*G03G 5/07* (2006.01)

(52) U.S. Cl.
CPC ..... *G03G 5/144* (2013.01); *G03G 5/076* (2013.01); *G03G 5/142* (2013.01)

(58) Field of Classification Search
CPC ..... G03G 5/144; G03G 5/142; G03G 5/14; G03G 5/076
USPC ..... 430/64, 65, 60
See application file for complete search history.

(56) References Cited

U.S. PATENT DOCUMENTS

| | | | | |
|---|---|---|---|---|
| 4,992,349 | A * | 2/1991 | Chen | G03G 5/0651 252/500 |
| 6,268,095 | B1 | 7/2001 | Kuroda | |
| 7,371,491 | B2 * | 5/2008 | Niimi | G03G 5/0696 399/159 |
| 7,541,124 | B2 * | 6/2009 | Molaire | G03G 5/056 430/123.4 |
| 7,560,203 | B2 | 7/2009 | Tamoto et al. | |
| 7,871,747 | B2 | 1/2011 | Shimoyama et al. | |
| 2014/0154620 | A1 * | 6/2014 | Ito | G03G 5/0609 430/56 |

FOREIGN PATENT DOCUMENTS

| | | | |
|---|---|---|---|
| JP | 2005-189828 | A | 7/2005 |
| JP | 3717320 | B2 | 11/2005 |
| JP | 2007-79555 | A | 3/2007 |
| JP | 4832182 | B2 | 12/2011 |

OTHER PUBLICATIONS

Diamond, A.S., ed., Handbook of Imaging Materials, Marcel Dekker, Inc., NY (1991), pp. 395-396.*
U.S. Appl. No. 14/568,511, filed Dec. 12, 2014. Inventor: Kazunori Noguchi, et al.
U.S. Appl. No. 14/568,714, filed Dec. 12, 2014. Inventor: Michiyo Sekiya, et al.
U.S. Appl. No. 14/573,410, filed Dec. 17, 2014. Inventor: Yota Ito, et al.
U.S. Appl. No. 14/568,052, filed Dec. 11, 2014. Inventor: Michiyo Sekiya, et al.
Yamashita, et al. (eds.), "Crosslinking Agent Handbook", Taiseisha, Ltd., 1981, pp. 536-605.

* cited by examiner

*Primary Examiner* — Janis L Dote
(74) *Attorney, Agent, or Firm* — Fitzpatrick, Cella, Harper & Scinto

(57) ABSTRACT

In an electrophotographic photosensitive member, a first intermediate layer contains a polymerized product of a composition including an electron transporting substance having a polymerizable functional group, and a crosslinking agent, and a second intermediate layer contains a binder resin and a metal oxide particle.

11 Claims, 3 Drawing Sheets

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus including the electrophotographic photosensitive member.

2. Description of the Related Art

Currently, an electrophotographic photosensitive member for use in a process cartridge and an electrophotographic apparatus is mainly an electrophotographic photosensitive member containing an organic photoconductive substance. The electrophotographic photosensitive member generally has a support and a photosensitive layer formed on the support. Then, an intermediate layer is provided between the support and the photosensitive layer for the purpose of suppressing charge injection from the support to the photosensitive layer (charge generating layer) to suppress the occurrence of an image defect such as fogging.

As the intermediate layer, an intermediate layer formed by a resin such as polyamide is known. Such an intermediate layer, however, exhibits ion conductivity, is particularly high in electric resistance under low-temperature and low-humidity, and is easily made high in residual potential.

In addition, a recent image forming apparatus in which coherent light such as laser light is used has the problem of causing an interference fringe. For the purposes of suppressing the occurrence of the interference fringe and controlling the electric resistance of the intermediate layer, a technique in which a metal oxide particle is contained in an intermediate layer is known. In such an intermediate layer containing a metal oxide particle, while the interference fringe is suppressed, the effect of suppressing fogging is easily insufficient.

In order to solve the problems, a technique has been proposed in which a first intermediate layer containing a resin and a second intermediate layer containing a metal oxide particle and a binder resin are stacked to thereby stabilize the potential of an electrophotographic photosensitive member in repeated use. For example, Japanese Patent Application Laid-Open No. 2005-189828 discloses an electrophotographic photosensitive member including a first intermediate layer containing polyamide, and a second intermediate layer containing a binder resin and a titanium oxide particle, stacked on the first intermediate layer. Japanese Patent No. 4832182 discloses an electrophotographic photosensitive member including a first intermediate layer containing polyamide and an electron transporting substance, and a second intermediate layer containing a binder resin and a titanium oxide particle, stacked on the first intermediate layer. Such conventional electrophotographic photosensitive members in which the intermediate layers are used currently satisfy a required image quality.

In recent years, however, a demand for the quality of an electrophotographic image has been increased, and the number of cases where the same image is output in large numbers in a short period of time has been increased.

In such a case, an image defect called a pattern memory easily occurs. The pattern memory refers to a phenomenon in which, when an image 301 including vertical lines 306 in FIG. 3A is continuously output in large numbers and then a solid black image 302 in FIG. 3B is output, the solid black image output is an image 304 including vertical lines 307 (FIG. 3C) caused by a repetition hysteresis of the vertical lines 306 in FIG. 3A. The pattern memory also refers to a phenomenon in which, when the image 301 in FIG. 3A is continuously output in large numbers and then a halftone image 303 in FIG. 3D is output, the halftone image output is an image 305 including vertical lines 308 (FIG. 3E) caused by the repetition hysteresis of the vertical lines 306 in FIG. 3A, as in the case of the solid black image.

The present inventors have made studies, and as a result, have found that the electrophotographic photosensitive members described in Japanese Patent Application Laid-Open No. 2005-189828 and Japanese Patent No. 4832182, in which charges are easily retained in the intermediate layers in repeated use and the pattern memory may occur, thus have a room for improvement.

The present invention is directed to providing an electrophotographic photosensitive member with a suppressed pattern memory, and a process cartridge and an electrophotographic apparatus including the electrophotographic photosensitive member.

SUMMARY OF THE INVENTION

According to one aspect of the present invention, there is provided an electrophotographic photosensitive member including a support, a first intermediate layer formed directly on the support, a second intermediate layer formed on the first intermediate layer, a charge generating layer formed on the second intermediate layer, and a hole transporting layer formed on the charge generating layer, wherein the first intermediate layer contains a polymerized product of a composition including an electron transporting substance having a polymerizable functional group and a cross-linking agent, and the second intermediate layer contains a binder resin and a metal oxide particle.

According to another aspect of the present invention, there is provided a process cartridge integrally supporting the electrophotographic photosensitive member and at least one unit selected from the group consisting of a charging unit, a developing unit and a cleaning unit, the process cartridge being attachable to and detachable from a main body of an electrophotographic apparatus.

According to further aspect of the present invention, there is provided an electrophotographic apparatus including the electrophotographic photosensitive member, an exposing unit, a charging unit, a developing unit and a transfer unit.

The present invention can provide an electrophotographic photosensitive member with a suppressed pattern memory, and a process cartridge and an electrophotographic apparatus including the electrophotographic photosensitive member.

Further features of the present invention will become apparent from the following description of exemplary embodiments with reference to the attached drawings.

DESCRIPTION OF THE EMBODIMENTS

Figure 1:
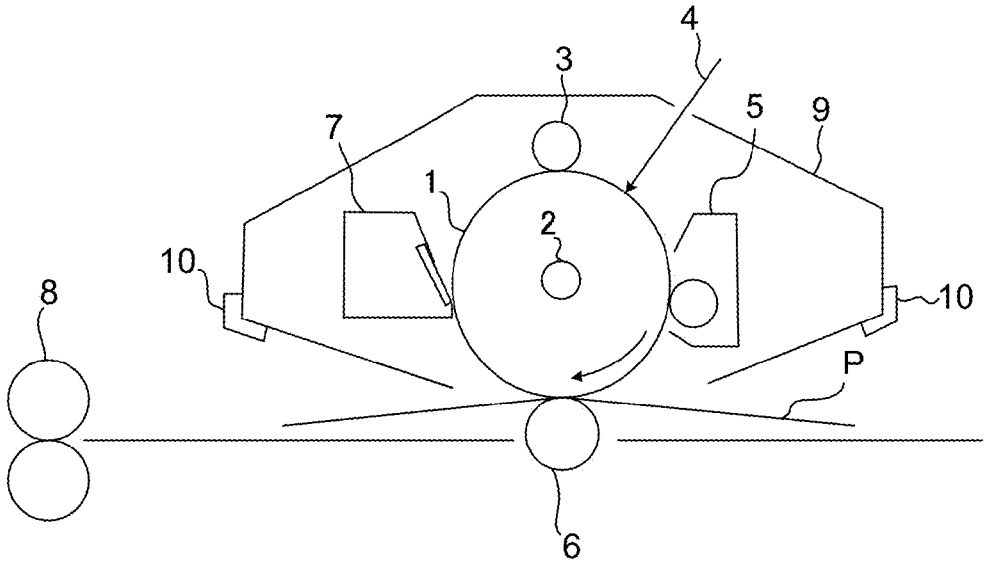
FIG. 1 is a view illustrating a schematic configuration of an electrophotographic apparatus including a process cartridge provided with an electrophotographic photosensitive member.

Preferred embodiments of the present invention will now be described in detail in accordance with the accompanying drawings.

The electrophotographic photosensitive member of the present invention includes a support, a first intermediate layer formed directly on the support, a second intermediate layer formed on the first intermediate layer, a charge generating layer formed on the second intermediate layer, and a hole transporting layer formed on the charge generating layer.

Then, the first intermediate layer contains a polymerized product (cured product) of a composition including an electron transporting substance having a polymerizable functional group and a crosslinking agent, and the second intermediate layer contains a binder resin and a metal oxide particle.

The reason why the electrophotographic photosensitive member of the present invention is excellent in suppression of a pattern memory is presumed by the present inventors as follows.

When the electrophotographic photosensitive member including the intermediate layers, the charge generating layer and the hole transporting layer stacked on the support is irradiated with exposure light (light to which an image is exposed), holes of charges (holes and electrons) generated in the charge generating layer are injected to the hole transporting layer. On the other hand, electrons are injected to the second intermediate layer and the first intermediate layer and move to the support. If electrons generated in the charge generating layer by light excitation cannot completely move from the second intermediate layer and the first intermediate layer to the support by the next charging, however, electrons are retained in the first intermediate layer and the second intermediate layer, and still move even at the time of the next charging. Such a phenomenon easily occurs in repeated use of the electrophotographic photosensitive member, and the number of electrons retained in the first intermediate layer and the second intermediate layer tends to be increased. Thus, the pattern memory is considered to occur.

An intermediate layer containing polyamide is higher in resistance under a low-temperature and low-humidity environment and in repeated use, and easily causes electrons to be retained. In addition, it is considered that even if an electron transporting substance is simply added for the purpose of an increase in electron transporting property, the electron transporting substance is easily dissolved in a solvent and thus is eluted in a photosensitive layer and a coating liquid in formation of a photosensitive layer on the intermediate layer, not imparting a sufficient electron transporting property.

On the contrary, the first intermediate layer in the present invention is formed by polymerization (curing) of the electron transporting substance having a polymerizable functional group and the crosslinking agent. Therefore, it is considered that the electron transporting substance is inhibited from being eluted and the first intermediate layer is less dependent on the environment and is inhibited from being degraded in repeated use.

Thus, according to the configuration of the present invention, the electron transporting ability by the polymerized product including the electron transporting substance of the first intermediate layer, and the electron transporting ability by conductivity of the metal oxide particle of the second intermediate layer hardly cause degradation in repeated use, allowing electrons to favorably flow. Therefore, it is considered that retention of electrons in the intermediate layers is decreased to suppress the pattern memory.

It has been further found that with respect to the stacking order of the first intermediate layer and the second intermediate layer, the first intermediate layer can be provided on the support to thereby further suppress the pattern memory. The reason for this is not clear, but the present inventors presume as follows.

The first intermediate layer having the polymerized product including the electron transporting substance is high in hole blocking property (hole suppression ability). On the contrary, the second intermediate layer having the metal oxide particle is low in hole blocking property. Therefore, when the first intermediate layer is provided on the support, a high hole blocking property allows holes to be retained directly below the first intermediate layer (the support). When electrons are generated in the charge generating layer by exposure in such a state, electrons move to holes directly below the first intermediate layer (the support) by a uniform force, and thus electrons easily flow to the support completely and retention of electrons hardly occurs. On the contrary, when the second intermediate layer is provided on the support, holes are easily injected from the support into the second intermediate layer, and when holes are injected into the second intermediate layer, holes may be trapped in the second intermediate layer. As a result, it is considered that holes are retained in the support and/or trapped in the second intermediate layer to be present on the surface of the support and the second intermediate layer with having a distribution in the thickness direction. When electrons are generated by exposure in the charge generating layer in such a state, electrons move towards the support, but electrons are partially bound to holes trapped in the second intermediate layer and thus tend to move in a gradually decreasing manner. As a result, electrons are presumed to be easily retained in the second intermediate layer and the first intermediate layer.

Figure 2:
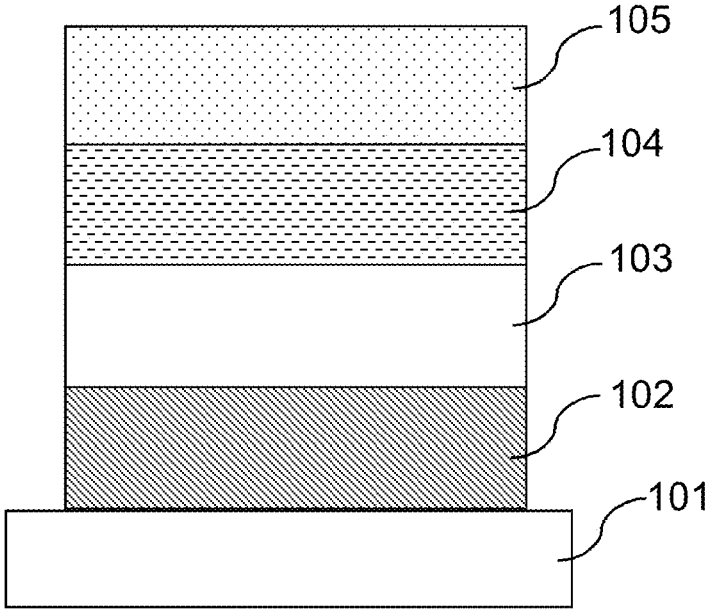
FIG. 2 is a view illustrating one example of a layer structure of the electrophotographic photosensitive member.
Figure 3A:
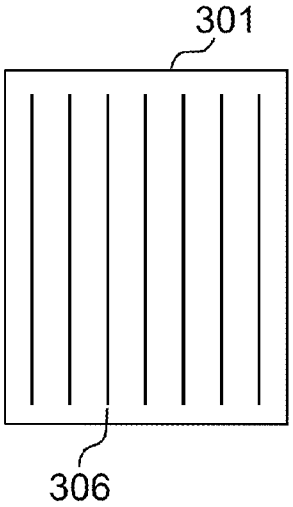
FIGS. 3A, 3B, 3C, 3D and 3E are views illustrating a pattern memory.
Figure 3B:
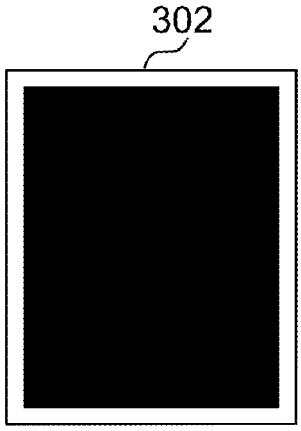
Figure 3D:
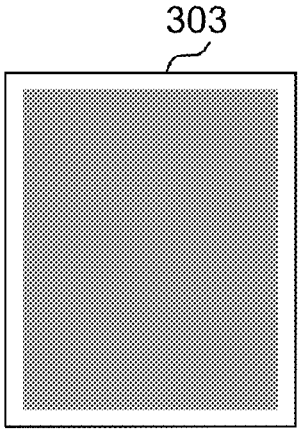
Figure 3C:
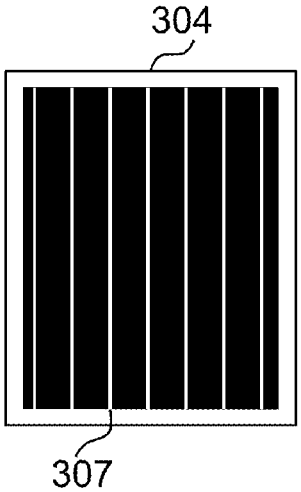
Figure 3E:
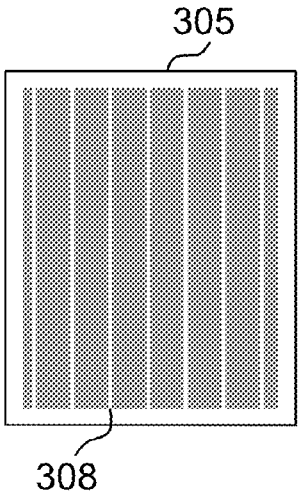

FIG. 2 is a view illustrating one example of a layer structure of the electrophotographic photosensitive member. In FIG. 2, the electrophotographic photosensitive member includes a first intermediate layer 102, a second intermediate layer 103, a charge generating layer 104 and a hole transporting layer 105 on a support 101.

An electrophotographic photosensitive member in which photosensitive layers (charge generating layer and hole transporting layer) are formed on a cylindrical electroconductive support is widely used as a general electrophotographic photosensitive member, but a belt-shaped or sheet-shaped electrophotographic photosensitive member can also be used.

[First Intermediate Layer]

The first intermediate layer in the present invention contains a polymerized product of a composition including an electron transporting substance having a polymerizable functional group, and a crosslinking agent.

The first intermediate layer can be formed as follows. A coating film of a first intermediate layer coating liquid containing the composition is formed, and the coating film is heated and dried to thereby polymerize (cure) the composition, forming the first intermediate layer.

A resin having a polymerizable functional group may also be further added to the composition including an electron transporting substance having a polymerizable functional group, and a crosslinking agent to polymerize the composition, forming the first intermediate layer. The polymerizable functional group of the resin can be a hydroxy group, a thiol group, an amino group, a carboxyl group or a methoxy group.

[Electron Transporting Substance]

Examples of the electron transporting substance having a polymerizable functional group include a quinone compound, an imide compound, a benzimidazole compound and a cyclopentadienylidene compound. The polymerizable functional group of the electron transporting substance includes a hydroxy group, a thiol group, an amino group, a carboxyl group or a methoxy group. Hereinafter, specific examples of the electron transporting substance having the polymerizable functional group include a compound represented by any of the following formulae (A1) to (A11).

(A1)

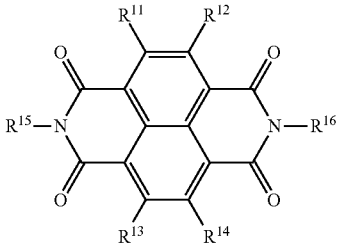

(A2)

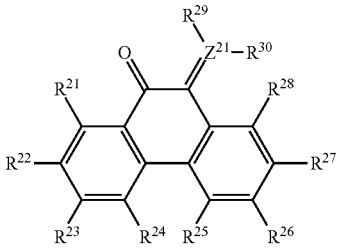

(A3)

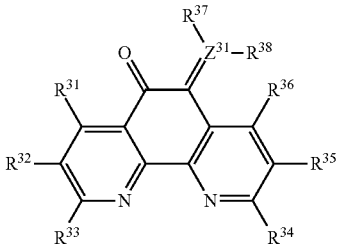

(A4)

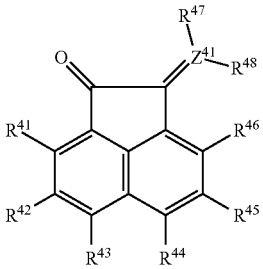

-continued (A5)

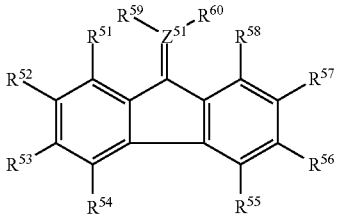

(A6)

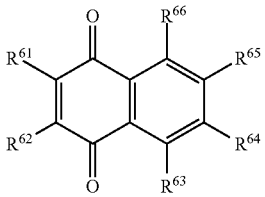

(A7)

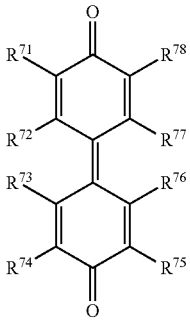

(A8)

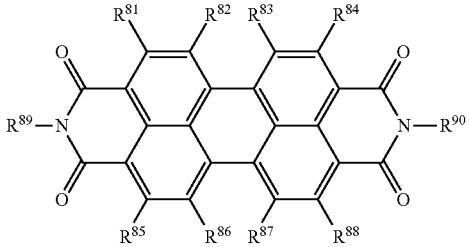

(A9)

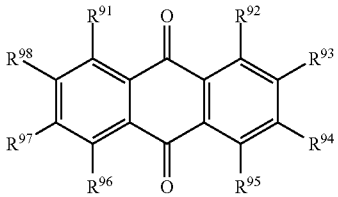

(A10)

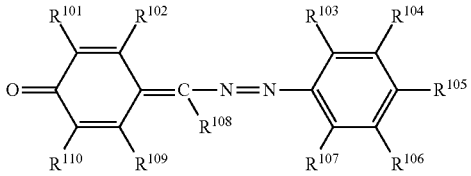

-continued (A11)

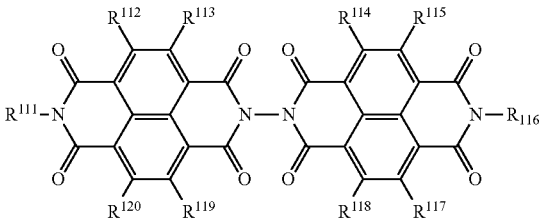

In the formulae (A1) to (A11), $R^{11}$ to $R^{16}$, $R^{21}$ to $R^{30}$, $R^{31}$ to $R^{38}$, $R^{41}$ to $R^{48}$, $R^{51}$ to $R^{60}$, $R^{61}$ to $R^{66}$, $R^{71}$ to $R^{78}$, $R^{81}$ to $R^{90}$, $R^{91}$ to $R^{98}$, $R^{101}$ to $R^{110}$ and $R^{111}$ to $R^{120}$ each independently represent a monovalent group represented by the following formula (A), a hydrogen atom, a cyano group, a nitro group, a halogen atom, an alkoxycarbonyl group, a substituted or unsubstituted alkyl group, a substituted or unsubstituted aryl group, a substituted or unsubstituted heterocyclic group, or a group derived by replacing one of $CH_2$ in the main chain of a substituted or unsubstituted alkyl group with O, S, NH or $NR^{121}$ ($R^{121}$ represents an alkyl group).

At least one of $R^{11}$ to $R^{16}$, at least one of $R^{21}$ to $R^{30}$, at least one of $R^{31}$ to $R^{38}$, at least one of $R^{41}$ to $R^{48}$, at least one of $R^{51}$ to $R^{60}$, at least one of $R^{61}$ to $R^{66}$, at least one of $R^{71}$ to $R^{78}$, at least one of $R^{81}$ to $R^{90}$, at least one of $R^{91}$ to $R^{98}$, at least one of $R^{101}$ to $R^{110}$, and at least one of $R^{111}$ to $R^{120}$ have the monovalent group represented by the formula (A).

The substituent of the substituted alkyl group is an alkyl group, aryl group, a halogen atom or an alkoxycarbonyl group. The substituent of the substituted aryl group and the substituent of the substituted heterocyclic group are each a halogen atom, a nitro group, a cyano group, an alkyl group, a halogen-substituted alkyl group or an alkoxy group. $Z^{21}$, $Z^{31}$, $Z^{41}$ and $Z^{51}$ each independently represent a carbon atom, a nitrogen atom or an oxygen atom. When $Z^{21}$ represents an oxygen atom, $R^{29}$ and $R^{30}$ are not present, and when $Z^{21}$ represents a nitrogen atom, $R^{30}$ is not present. When $Z^{31}$ represents an oxygen atom, $R^{37}$ and $R^{38}$ are not present, and when $Z^{31}$ represents a nitrogen atom, $R^{38}$ is not present. When $Z^{41}$ represents an oxygen atom, $R^{47}$ and $R^{48}$ are not present, and when $Z^{41}$ represents a nitrogen atom, $R^{48}$ is not present. When $Z^{51}$ represents an oxygen atom, $R^{59}$ and $R^{60}$ are not present, and when $Z^{51}$ represents a nitrogen atom, $R^{60}$ is not present.

$$-(\alpha)_l-(\beta)_m-\gamma \quad \text{(A)}$$

In the formula (A), at least one of α, β and γ represent a group having a polymerizable functional group, the polymerizable functional group is at least one group selected from the group consisting of a hydroxy group, a thiol group, an amino group, a carboxyl group and a methoxy group, l and m each independently denote 0 or 1, and the sum of l and m is 0 or more and 2 or less.

α represents a substituted or unsubstituted alkylene group having 1 to 6 atoms in the main chain, or a group derived by replacing one of $CH_2$ in the main chain of a substituted or unsubstituted alkylene group having 1 to 6 atoms in the main chain with O, S or $NR^{122}$ (wherein $R^{122}$ represents a hydrogen atom or an alkyl group.). The substituent of the alkylene group includes an alkyl group having 1 to 6 carbon atoms, a benzyl group, an alkoxycarbonyl group or a phenyl group. Such groups may have at least one group selected from the group consisting of a hydroxy group, a thiol group, an amino group and a carboxyl group, as the polymerizable functional group.

β represents a phenylene group, a phenylene group substituted with an alkyl group having 1 to 6 carbon atoms, a phenylene group substituted with a nitro group, a phenylene group substituted with a halogen group or a phenylene group substituted with an alkoxy group. Such groups may have at least one group selected from the group consisting of a hydroxy group, a thiol group, an amino group, a carboxyl group and a methoxy group, as the polymerizable functional group.

γ represents a hydrogen atom, a substituted or unsubstituted alkyl group having 1 to 6 atoms in the main chain, or a group derived by replacing one of $CH_2$ in the main chain of a substituted or unsubstituted alkyl group having 1 to 6 atoms in the main chain with O, S or $NR^{123}$ (wherein $R^{123}$ represents a hydrogen atom or an alkyl group.). Such groups may have at least one group selected from the group consisting of a hydroxy group, a thiol group, an amino group, a carboxyl group and a methoxy group, as the polymerizable functional group.

Hereinafter, specific examples (exemplary compounds) of the electron transporting substance having a polymerizable functional group are shown. Herein, exemplary compounds in Tables 1 to 11 below are the compounds represented by the formulae (A1) to (A11), respectively. In Tables, Aa is represented by a structural formula as in the case of A. That is to say, A and Aa respectively represent the monovalent group represented by the formula (A), and specific examples of the monovalent group are shown in the columns of A and Aa. In Tables, when γ denotes "-", γ represents a hydrogen atom, and the hydrogen atom of γ is represented, with being included in the structure shown in the column of α or β. In the following Tables, bonds indicated by a dot line are bound to each other.

TABLE 1

| Exemplary compound | $R^{11}$ | $R^{12}$ | $R^{13}$ | $R^{14}$ | $R^{15}$ | $R^{16}$ | A α | A β | A γ | Aa α | Aa β | Aa γ |
|---|---|---|---|---|---|---|---|---|---|---|---|---|
| A101 | H | H | H | H | 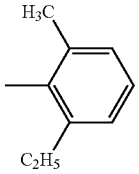 | A | 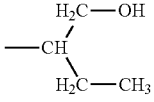 | — | — | — | — | — |

TABLE 1-continued
| Exemplary compound | $R^{11}$ | $R^{12}$ | $R^{13}$ | $R^{14}$ | $R^{15}$ | $R^{16}$ | A α | A β | A γ | Aa α | Aa β | Aa γ |
|---|---|---|---|---|---|---|---|---|---|---|---|---|
| A102 | H | H | H | H | 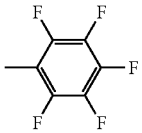 | A | 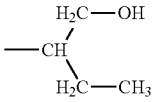 | — | — | — | — | — |
| A103 | H | H | H | H | 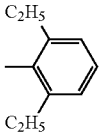 | A | — | 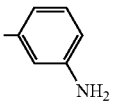 | — | — | — | — |
| A104 | H | H | H | H | 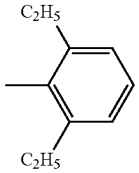 | A | — | 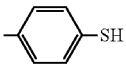 | — | — | — | — |
| A105 | H | H | H | H | 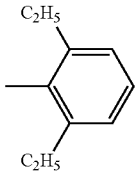 | A | 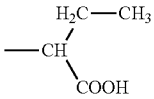 | — | — | — | — | — |
| A106 | H | H | H | H | A | A | 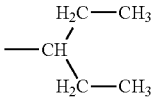 | — | — | — | — | — |
| A107 | H | H | H | H | A | A | 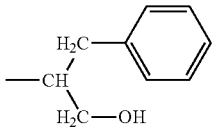 | — | — | — | — | — |
| A108 | H | H | H | H | 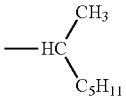 | A | 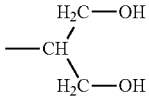 | — | — | — | — | — |
| A109 | H | H | H | H | 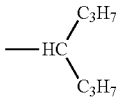 | A | 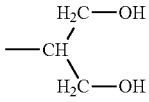 | — | — | — | — | — |
| A110 | H | H | H | H | 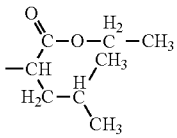 | A | 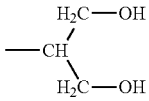 | — | — | — | — | — |

TABLE 1-continued
| Exemplary compound | $R^{11}$ | $R^{12}$ | $R^{13}$ | $R^{14}$ | $R^{15}$ | $R^{16}$ | A α | A β | A γ | Aa α | Aa β | Aa γ |
|---|---|---|---|---|---|---|---|---|---|---|---|---|
| A111 | H | H | H | H | 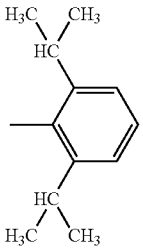 | A | 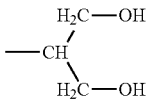 | — | — | — | — | — |
| A112 | H | H | H | H | 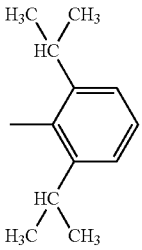 | A | 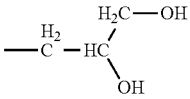 | — | — | — | — | — |
| A113 | H | H | H | H | A | A | 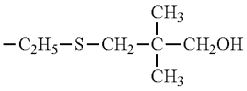 | — | — | — | — | — |
| A114 | H | H | H | H | A | A | 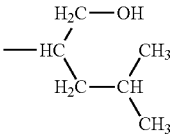 | — | — | — | — | — |
| A115 | H | H | H | H | A | Aa | $—C_2H_4—S—C_2H_4—OH$ | — | — | 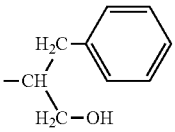 | — | — |
| A116 | H | H | H | H | A | Aa | 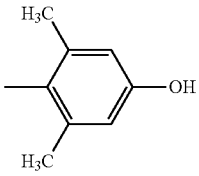 | — | — | 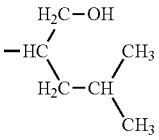 | — | — |
| A117 | H | H | H | H | A | Aa | — | 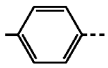 | ---$CH_2$–OH | 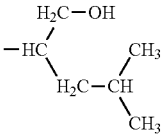 | — | — |
| A118 | H | H | H | H | A | Aa | — | 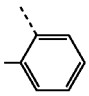 | ---$CH_2$–OH | 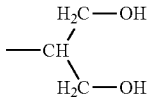 | — | — |
| A119 | H | H | H | H | A | Aa | 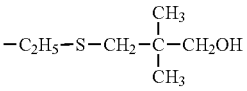 | — | — | 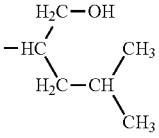 | — | — |

TABLE 1-continued

| Exemplary compound | $R^{11}$ | $R^{12}$ | $R^{13}$ | $R^{14}$ | $R^{15}$ | $R^{16}$ | A α | A β | A γ | Aa α | Aa β | Aa γ |
|---|---|---|---|---|---|---|---|---|---|---|---|---|
| A120 | H | H | H | H | A | A | 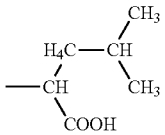 | — | — | — | — | — |

TABLE 2

| Exemplary compound | $R^{21}$ | $R^{22}$ | $R^{23}$ | $R^{24}$ | $R^{25}$ | $R^{26}$ | $R^{27}$ | $R^{28}$ | $R^{29}$ | $R^{30}$ | $Z^{21}$ | A α | A β | A γ |
|---|---|---|---|---|---|---|---|---|---|---|---|---|---|---|
| A201 | H | H | A | H | H | H | H | H | — | — | O | — | 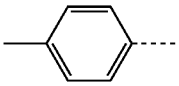 | ----$CH_2$—OH |
| A202 | H | H | H | H | H | H | H | H | A | — | N | — | 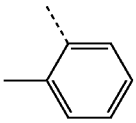 | $H_2C$—OH / ----$CH_2$ |
| A203 | H | H | 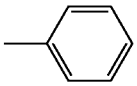 | H | H | 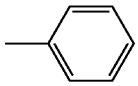 | H | H | A | — | N | — | 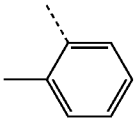 | $H_2C$—OH / ----$CH_2$ |
| A204 | H | H | 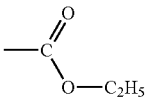 | H | H | 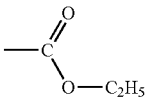 | H | H | A | — | N | — | 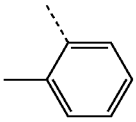 | $H_2C$—OH / ----$CH_2$ |
| A205 | H | H | A | H | H | A | H | H | — | — | O | — | 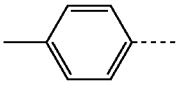 | ----$CH_2$—OH |
| A206 | H | A | H | H | H | H | A | H | — | — | O | — | 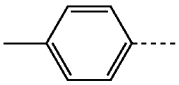 | ----$CH_2$—OH |

TABLE 3

| Exemplary compound | $R^{31}$ | $R^{32}$ | $R^{33}$ | $R^{34}$ | $R^{35}$ | $R^{36}$ | $R^{37}$ | $R^{38}$ | $z^{31}$ | A α | A β | A γ |
|---|---|---|---|---|---|---|---|---|---|---|---|---|
| A301 | H | A | H | H | H | H | — | — | O | — | 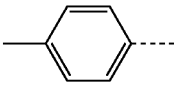 | ----$CH_2$—OH |
| A302 | H | H | H | H | H | H | A | — | N | — | 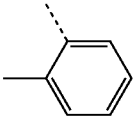 | $H_2C$—OH / ----$CH_2$ |

TABLE 3-continued

| Exemplary compound | $R^{31}$ | $R^{32}$ | $R^{33}$ | $R^{34}$ | $R^{35}$ | $R^{36}$ | $R^{37}$ | $R^{38}$ | $z^{31}$ | A α | A β | A γ |
|---|---|---|---|---|---|---|---|---|---|---|---|---|
| A303 | H | H | H | H | H | H | A | — | N | $H_2C—OH$ / —CH \ $H_2C—CH_3$ | — | — |
| A304 | H | H | Cl | Cl | H | H | A | — | N | — | 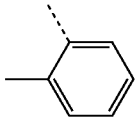 | $H_2C—OH$ / ----$CH_2$ |
| A305 | H | A | H | H | A | H | CN | CN | C | — | 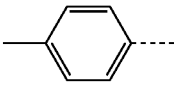 | ----$CH_2—OH$ |

TABLE 4

| Exemplary compound | $R^{41}$ | $R^{42}$ | $R^{43}$ | $R^{44}$ | $R^{45}$ | $R^{46}$ | $R^{47}$ | $R^{48}$ | $Z^{41}$ | A α | A β | A γ |
|---|---|---|---|---|---|---|---|---|---|---|---|---|
| A401 | H | H | A | H | H | H | CN | CN | C | — | 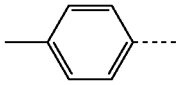 | ----$CH_2—OH$ |
| A402 | H | H | H | H | H | H | A | — | N | — | 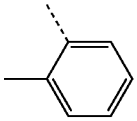 | $H_2C—OH$ / ----$CH_2$ |
| A403 | H | H | A | A | H | H | CN | CN | C | — | 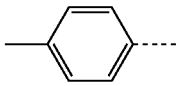 | ----$CH_2—OH$ |
| A404 | H | H | A | A | H | H | CN | CN | C | — | 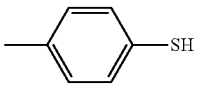 | — |
| A405 | H | H | A | A | H | H | — | — | O | — | 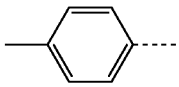 | ----$CH_2—OH$ |

TABLE 5

| Exemplary compound | $R^{51}$ | $R^{52}$ | $R^{53}$ | $R^{54}$ | $R^{55}$ | $R^{56}$ | $R^{57}$ | $R^{58}$ | $R^{59}$ | $R^{69}$ | $Z^{51}$ | A α | A β | A γ |
|---|---|---|---|---|---|---|---|---|---|---|---|---|---|---|
| A501 | H | A | H | H | H | H | H | H | CN | CN | C | — | 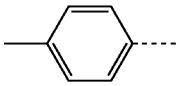 | ----$CH_2—OH$ |
| A502 | H | $NO_2$ | H | H | $NO_2$ | H | $NO_2$ | H | A | — | N | — | 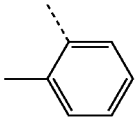 | $H_2C—OH$ / ----$CH_2$ |

TABLE 5-continued

| Exemplary compound | $R^{51}$ | $R^{52}$ | $R^{53}$ | $R^{54}$ | $R^{55}$ | $R^{56}$ | $R^{57}$ | $R^{58}$ | $R^{59}$ | $R^{69}$ | $Z^{51}$ | A α | A β | A γ |
|---|---|---|---|---|---|---|---|---|---|---|---|---|---|---|
| A503 | H | A | H | H | H | H | A | H | CN | CN | C | 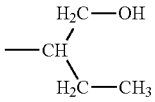 | — | — |
| A504 | H | H | A | H | H | A | H | H | CN | CN | C | — | 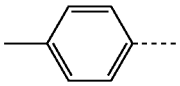 | ----$CH_2$—OH |

TABLE 6

| Exemplary compound | $R^{61}$ | $R^{62}$ | $R^{63}$ | $R^{64}$ | $R^{65}$ | $R^{66}$ | A α | A β | A γ |
|---|---|---|---|---|---|---|---|---|---|
| A601 | A | H | H | H | H | H | — | 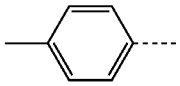 | ----$CH_2$—OH |
| A602 | A | H | H | H | H | H | — | 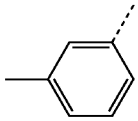 | ----$CH_2$—OH |
| A603 | A | H | H | H | H | H | 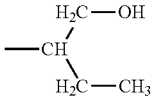 | — | — |
| A604 | A | A | H | H | H | H | — | 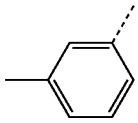 | ----$CH_2$—OH |
| A605 | A | A | H | H | H | H | 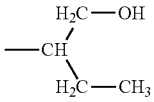 | — | — |

TABLE 7

| Exemplary compound | $R^{71}$ | $R^{72}$ | $R^{73}$ | $R^{74}$ | $R^{75}$ | $R^{76}$ | $R^{77}$ | $R^{78}$ | A α | A β | A γ | Aa α | Aa β | Aa γ |
|---|---|---|---|---|---|---|---|---|---|---|---|---|---|---|
| A701 | A | H | H | H | H | H | H | H | — | 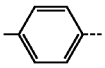 | ----$CH_2$—OH | — | — | — |
| A702 | A | H | H | H | H | H | H | H | 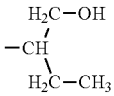 | — | — | — | — | — |
| A703 | A | H | H | H | A | H | H | H | — | 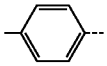 | ----$CH_2$—OH | — | — | — |

TABLE 7-continued

| Exemplary compound | $R^{71}$ | $R^{72}$ | $R^{73}$ | $R^{74}$ | $R^{75}$ | $R^{76}$ | $R^{77}$ | $R^{78}$ | A α | A β | A γ | Aa α | Aa β | Aa γ |
|---|---|---|---|---|---|---|---|---|---|---|---|---|---|---|
| A704 | A | H | H | H | Aa | H | H | H | $H_2C-OH$ / $-CH$ \ $H_2C-CH_3$ | — | — | — | 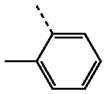 | ----$CH_2-OH$ |
| A705 | A | H | H | H | Aa | H | H | H | — | 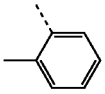 | ----$CH_2-OH$ | $-(CH_2)_5-OH$ | — | — |

TABLE 8

| Exemplary compound | $R^{81}$ | $R^{82}$ | $R^{83}$ | $R^{84}$ | $R^{85}$ | $R^{86}$ | $R^{87}$ | $R^{88}$ | $R^{89}$ | $R^{90}$ | A α | A β | A γ |
|---|---|---|---|---|---|---|---|---|---|---|---|---|---|
| A801 | H | H | H | H | H | H | H | H | 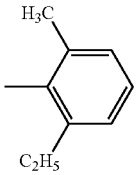 | A | $H_2C-OH$ / $-CH$ \ $H_2C-CH_3$ | — | — |
| A802 | H | H | H | H | H | H | H | H | 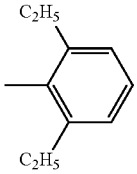 | A | — | $H_2C-CH_3$ / $-CH$ \ COOH | — |
| A803 | H | CN | H | H | H | H | CN | H | 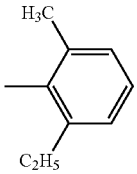 | A | $H_2C-OH$ / $-CH$ \ $H_2C-CH_3$ | — | — |
| A804 | H | H | H | H | H | H | H | H | A | A | $H_2C-OH$ / $-CH$ \ $H_2C-CH_3$ | — | — |
| A805 | H | H | H | H | H | H | H | H | A | A | — | 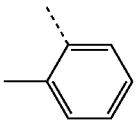 | $H_2C-OH$ / ----$CH_2$ |

TABLE 9

| Exemplary compound | $R^{91}$ | $R^{92}$ | $R^{93}$ | $R^{94}$ | $R^{95}$ | $R^{96}$ | $R^{97}$ | $R^{98}$ | A α | A β | A γ |
|---|---|---|---|---|---|---|---|---|---|---|---|
| A901 | A | H | H | H | H | H | H | H | $-CH_2-OH$ | — | — |
| A902 | A | H | H | H | H | H | H | H | $-(CH_2)_2-OH$ | — | — |
| A903 | H | H | H | H | H | H | H | A | $-CH_2-OH$ | — | — |
| A904 | H | H | H | H | H | H | H | A | $-(CH_2)_2-OH$ | — | — |

TABLE 9-continued

| Exemplary compound | $R^{91}$ | $R^{92}$ | $R^{93}$ | $R^{94}$ | $R^{95}$ | $R^{96}$ | $R^{97}$ | $R^{98}$ | A α | A β | A γ |
|---|---|---|---|---|---|---|---|---|---|---|---|
| A905 | H | CN | H | H | H | H | CN | A | — | 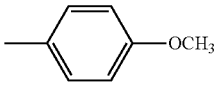 | — |
| A906 | A | A | H | $NO_2$ | H | H | $NO_2$ | H | $-(CH_2)_2-OH$ | — | — |
| A907 | H | A | A | H | H | H | H | H | $-CH_2-OH$ | — | — |

TABLE 10

| Exemplary compound | $R^{101}$ | $R^{102}$ | $R^{103}$ | $R^{104}$ | $R^{105}$ | $R^{106}$ | $R^{107}$ | $R^{108}$ | $R^{109}$ | $R^{110}$ | A α | A β | A γ |
|---|---|---|---|---|---|---|---|---|---|---|---|---|---|
| A1001 | 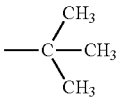 | H | H | H | A | H | H | H | H | 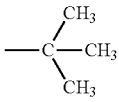 | $-CH_2-OH$ | — | — |
| A1002 | 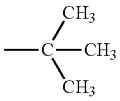 | H | H | H | A | H | H | H | H | 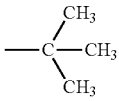 | — | 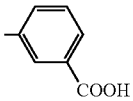 | — |
| A1003 | 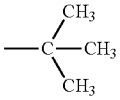 | H | H | H | A | H | H | H | H | 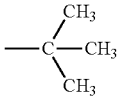 | — | 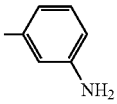 | — |
| A1004 | 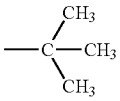 | H | H | H | A | H | H | H | H | 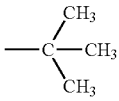 | — | 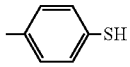 | — |
| A1005 | 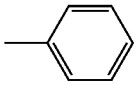 | H | H | H | A | H | H | H | H | 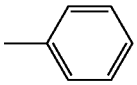 | $-CH_2-OH$ | — | — |

TABLE 11

| Exemplary compound | $R^{111}$ | $R^{112}$ | $R^{113}$ | $R^{114}$ | $R^{115}$ | $R^{116}$ | $R^{117}$ | $R^{118}$ | $R^{119}$ | $R^{120}$ | A α | A β | A γ |
|---|---|---|---|---|---|---|---|---|---|---|---|---|---|
| A1101 | A | H | H | H | H | A | H | H | H | H | 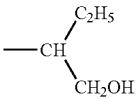 | — | — |
| A1102 | A | H | H | H | H | A | H | H | H | H | 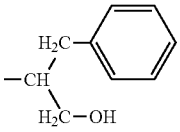 | — | — |
| A1103 | A | H | H | H | H | A | H | H | H | H | — | 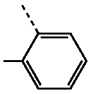 | 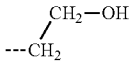 |

TABLE 11-continued

| Exemplary compound | $R^{111}$ | $R^{112}$ | $R^{113}$ | $R^{114}$ | $R^{115}$ | $R^{116}$ | $R^{117}$ | $R^{118}$ | $R^{119}$ | $R^{120}$ | A α | A β | A γ |
|---|---|---|---|---|---|---|---|---|---|---|---|---|---|
| A1104 | A | H | H | H | H | 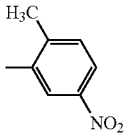 | H | H | H | H | 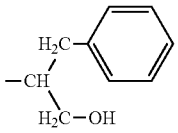 | — | — |
| A1105 | A | H | H | H | H | 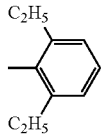 | H | H | H | H | 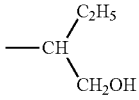 | — | — |

A derivative having a structure of any of (A2) to (A6) and (A9) (derivative of electron transporting substance) can be purchased from Tokyo Chemical Industry Co., Ltd., Sigma-Aldrich Japan K.K., or Johnson Matthey Japan G.K. A derivative having a structure of (A1) can be synthesized by a reaction of naphthalenetetracarboxylic dianhydride that can be purchased from Tokyo Chemical Industry Co., Ltd., Sigma-Aldrich Japan K.K. or Johnson Matthey Japan G.K. with a monoamine derivative. A derivative having a structure of (A7) can be synthesized by using a phenol derivative that can be purchased from Tokyo Chemical Industry Co., Ltd. or Sigma-Aldrich Japan K.K. as a raw material. A derivative having a structure of (A8) can be synthesized by a reaction of perylenetetracarboxylic dianhydride that can be purchased from Tokyo Chemical Industry Co., Ltd. or Sigma-Aldrich Japan K.K. with a monoamine derivative. A derivative having a structure of (A10) can be synthesized by using a known synthesis method described in, for example, Japanese Patent No. 3717320 to oxidize a phenol derivative having a hydrazone structure by a proper oxidant such as potassium permanganate in an organic solvent. A derivative having a structure of (A11) can be synthesized by a reaction of naphthalenetetracarboxylic dianhydride that can be purchased from Tokyo Chemical Industry Co., Ltd., Sigma-Aldrich Japan K.K. or Johnson Matthey Japan G.K. with a monoamine derivative and hydrazine.

A compound represented by any of (A1) to (A11) has a polymerizable functional group (hydroxy group, thiol group, amino group, carboxyl group and methoxy group) polymerizable with the crosslinking agent. Examples of the method for introducing the polymerizable functional group to a derivative having a structure of any of (A1) to (A11) to synthesize the compound represented by any of (A1) to (A11) include the following methods: a method including synthesizing the derivative having a structure of any of (A1) to (A11), and then directly introducing the polymerizable functional group; and a method including synthesizing the derivative having a structure of any of (A1) to (A11), and then introducing a structure having a functional group that can serve as the polymerizable functional group or a precursor of the polymerizable functional group. Examples of the latter method include a method including performing a cross-coupling reaction of, for example, a halide of the derivative having a structure of any of (A1) to (A11) with use of, for example, a palladium catalyst and a base to introduce an aryl group having the functional group; a method including performing a cross-coupling reaction of a halide of the derivative having a structure of any of (A1) to (A11) with use of a $FeCl_3$ catalyst and a base to introduce an alkyl group having the functional group; and a method including performing lithiation of a halide of the derivative having a structure of any of (A1) to (A11), and then allowing an epoxy compound and $CO_2$ to act to thereby introduce a hydroxyalkyl group and a carboxyl group.

The electron transporting substance having a polymerizable functional group can have two or more polymerizable functional groups in the same molecule.

The content of the electron transporting substance having a polymerizable functional group is preferably 30% by mass or more based on the total mass of the composition including the electron transporting substance having a polymerizable functional group, and the crosslinking agent and/or the resin having a polymerizable functional group. When the content is 30% by mass or more, electron injection and electron transporting property from the second intermediate layer to the first intermediate layer are further improved, and the pattern memory is further suppressed. The content is more preferably 30% by mass or more and 70% by mass or less.

[Crosslinking Agent]

Then, the crosslinking agent is described. As the crosslinking agent, a compound can be used which is polymerized or crosslinked with the electron transporting substance having a polymerizable functional group, and the resin having a polymerizable functional group. That is, the crosslinking agent has a functional group that can react with the polymerizable functional group of the electron transporting substance. Specifically, compounds described in "Crosslinking Agent Handbook", edited by Shinzo Yamashita and Tosuke Kaneko, published by Taiseisha Ltd. (1981), can be used. For example, an isocyanate compound having an isocyanate group or a block isocyanate group or an amine compound having an N-methylol group or an alkyletherified N-methylol group can be used.

The isocyanate compound can be an isocyanate compound having 2 to 6 isocyanate groups or block isocyanate groups. In addition, the molecular weight of the isocyanate compound can be in the range from 200 to 1300.

The block isocyanate group is a group having a structure of —$NHCOX^1$ (wherein $X^1$ represents a protective group). $X^1$ may be any protective group that can be introduced to an isocyanate group, but can be a group represented by any of the following formulae (H1) to (H7).

(H1)

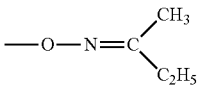

(H2)

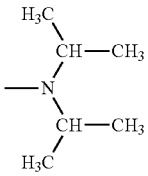

(H3)

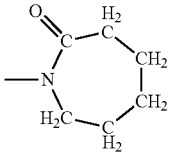

(H4)

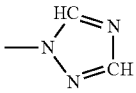

(H5)

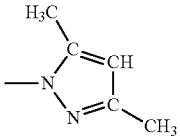

-continued (H6)

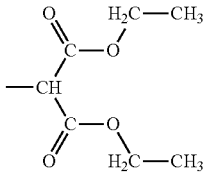

(H7)

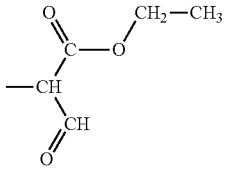

Examples of the isocyanate compound include isocyanurate modifications, biuret modifications, allophanate modifications and trimethylolpropane or pentaerythritol adduct modifications of diisocyanate, such as triisocyanatobenzene, triisocyanatomethylbenzene, triphenylmethane triisocyanate, lysine triisocyanate, tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanate hexanoate and norbornane diisocyanate.

Hereinafter, specific examples of the isocyanate compound include compounds represented by the following formulae (B1) to (B21).

(B1)

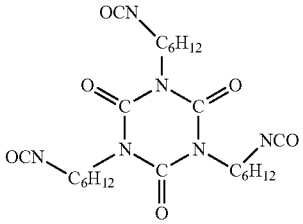

(B2)

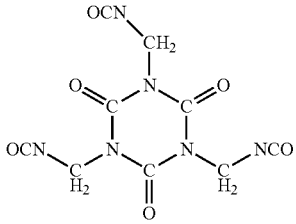

(B3)

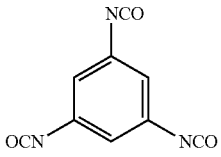

(B4)

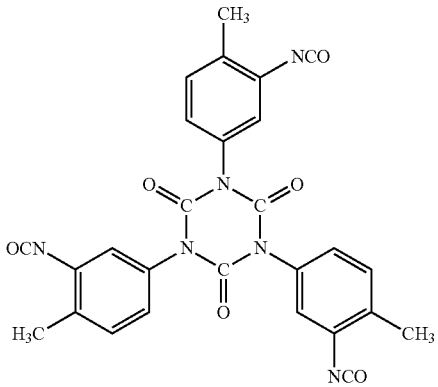

-continued
(B5)
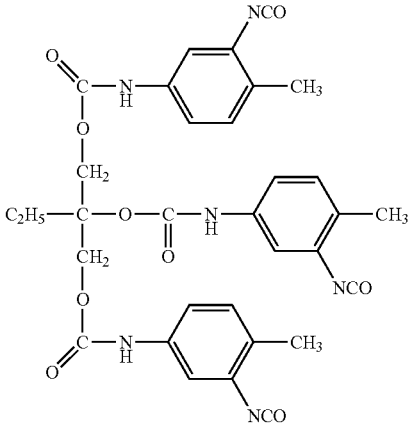
(B6)
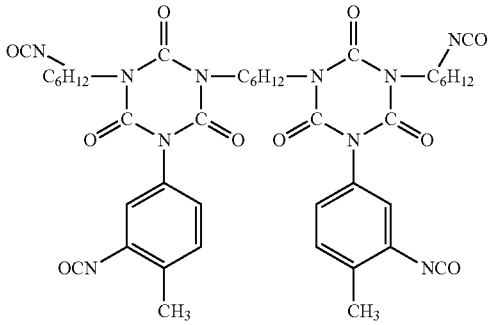
(B7)
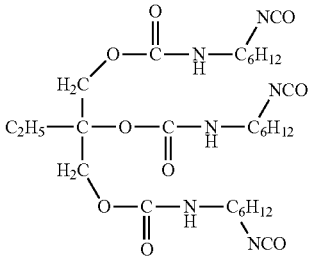
(B8)
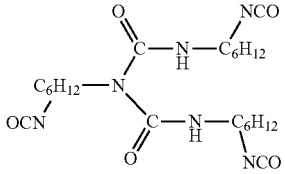
(B9)
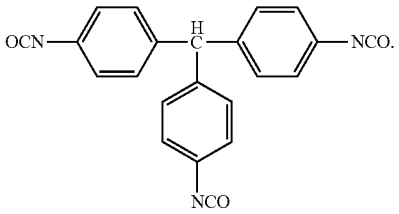
(B10)
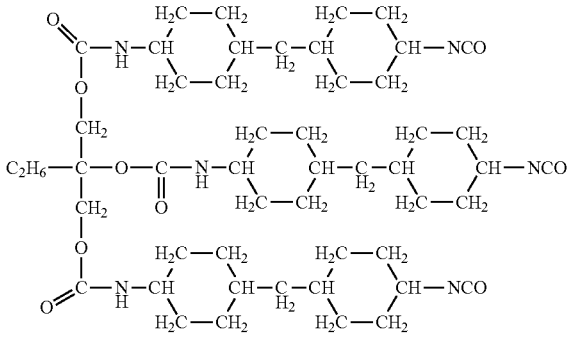
(B11)
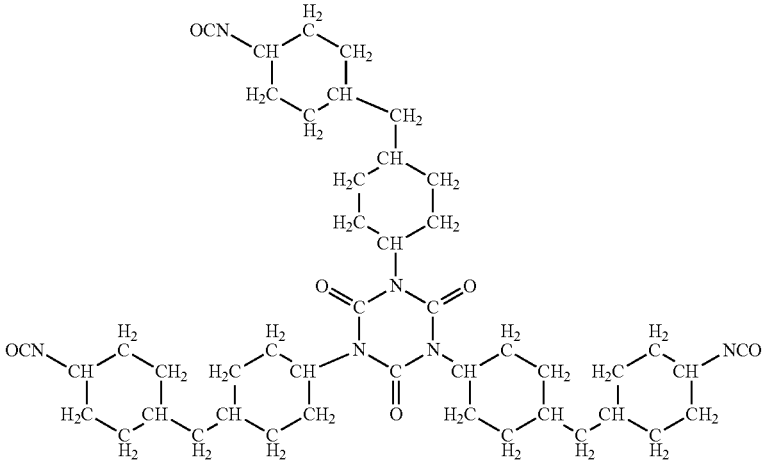

-continued
(B12)
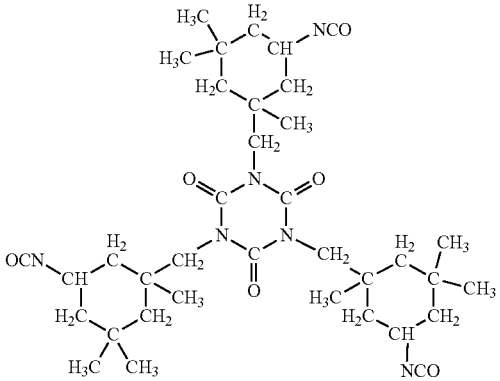
(B13)
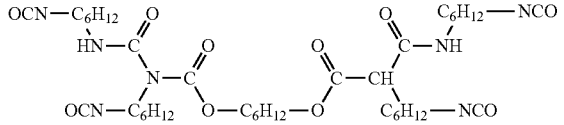
(B14)
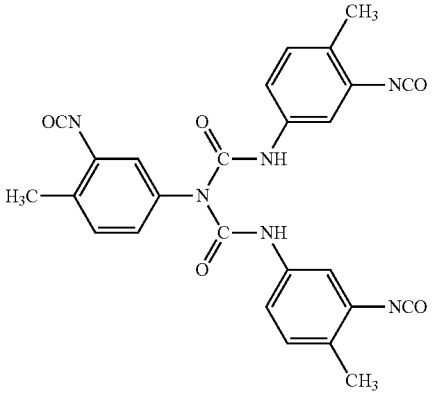
(B15)
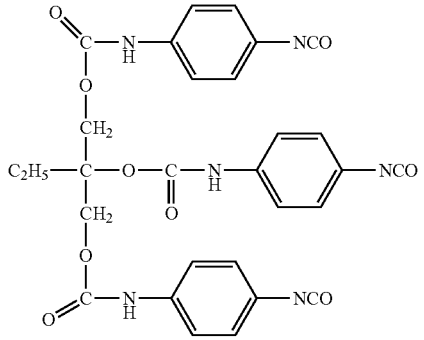
(B16)
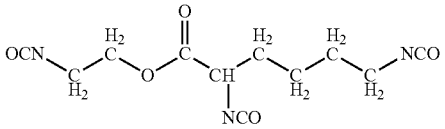
(B17)
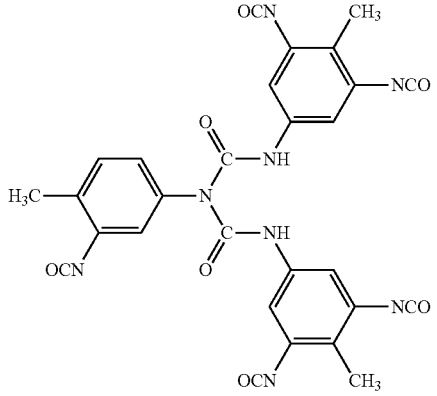
(B18)
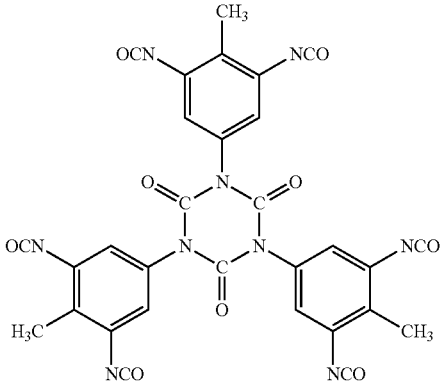
(B19)
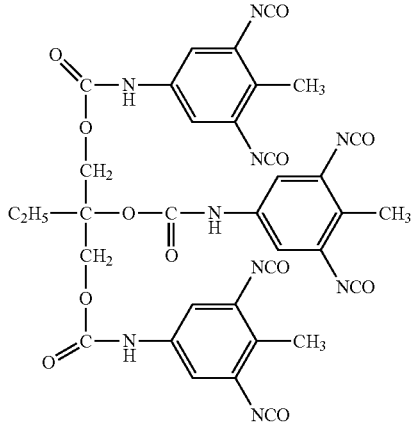

-continued (B20)

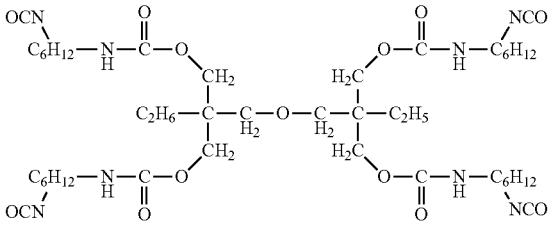

(B21)

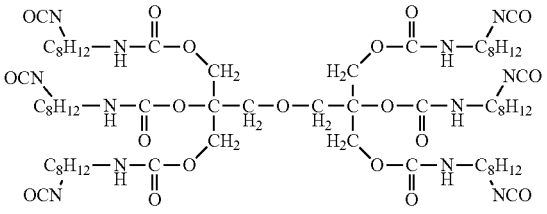

The amine compound can be, for example, an amine compound having a plurality of (two or more) N-methylol groups or alkyletherified N-methylol groups. Examples of the amine compound include a melamine compound, a guanamine compound and a urea compound. The amine compound is preferably a compound represented by any of the following formulae (C1) to (C5), or an oligomer of the compound represented by any of the following formulae (C1) to (C5). When the oligomer is contained, the degree of polymerization of the oligomer can be 2 or more and 100 or less. The amine compound is more preferably a melamine compound represented by the formula (C1) or a guanamine compound represented by the formula (C2).

(C1)

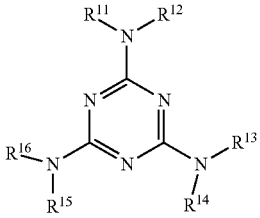

(C2)

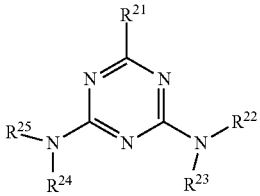

(C3)

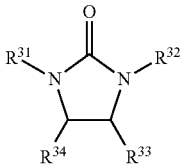

(C4)

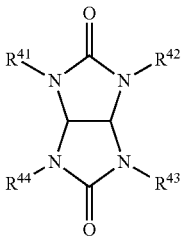

-continued (C5)

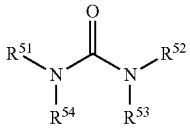

In the formulae (C1) to (C5), $R^{11}$ to $R^{16}$, $R^{22}$ to $R^{25}$, $R^{31}$ to $R^{34}$, $R^{41}$ to $R^{44}$ and $R^{51}$ to $R^{54}$ each independently represent a hydrogen atom, a hydroxy group, an acyl group or a monovalent group represented by $—CH_2—OR^1$. At least one of $R^{11}$ to $R^{16}$, at least one of $R^{22}$ to $R^{25}$, at least one of $R^{31}$ to $R^{34}$, at least one of $R^{41}$ to $R^{44}$ and at least one of $R^{51}$ to $R^{54}$ are each the monovalent group represented by $—CH_2—OR^1$. $R^1$ represents a hydrogen atom or an alkyl group having 1 or more and 10 or less carbon atoms. The alkyl group can be a methyl group, an ethyl group, a propyl group (n-propyl group or iso-propyl group) or a butyl group (n-butyl group, iso-butyl group or tert-butyl group) from the viewpoint of polymerizing property. $R^{21}$ represents an aryl group, an aryl group substituted with an alkyl group, a cycloalkyl group or a cycloalkyl group substituted with an alkyl group.

Hereinafter, specific examples of the compound represented by any of the formulae (C1) to (C5) are shown. The oligomer and monomer described above can be used as a mixture of two or more.

Examples of the compound represented by the formula (C1) include Super Melami No. 90 (produced by NOF Corporation), Super Beckamine (R)TD-139-60, L-105-60, L127-60, L110-60, J-820-60 and G-821-60 (produced by DIC Corporation), Yuban 2020 (Mitsui Chemicals Inc.), Sumitex Resin M-3 (Sumitomo Chemical Co., Ltd.), and Nikalac MW-30, MW-390 and MX-750LM (produced by Nippon Carbide Industries, Co., Inc.). Examples of the compound represented by the formula (C2) include Super Beckamine (R)L-148-55, 13-535, L-145-60, TD-126 (produced by DIC Corporation), and Nikalac BL-60 and BX-4000 (produced by Nippon Carbide Industries, Co., Inc.). Examples of the compound represented by the formula (C3) include Nikalac MX-280 (produced by Nippon Carbide Industries, Co., Inc.). Examples of the compound represented by the formula (C4) include Nikalac MX-270 (produced by Nippon Carbide Industries, Co., Inc.). Examples of the compound represented by the formula (C5) include Nikalac MX-290 (produced by Nippon Carbide Industries, Co., Inc.).

Hereinafter, as specific examples of the compound represented by the formula (C1), compounds represented by the following formulae (C1-1) to (C1-12) are shown. Bu represents a butyl group.

(C1-1)
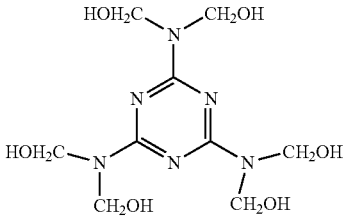
(C1-2)
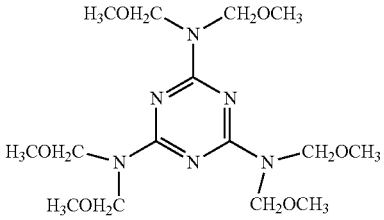
(C1-3)
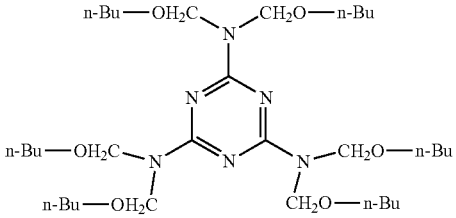
(C1-4)
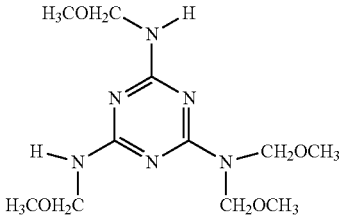
(C1-5)
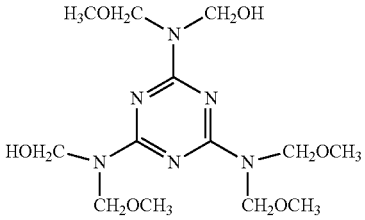
(C1-6)
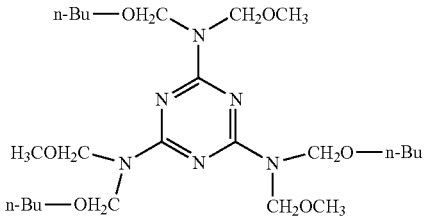
(C1-7)
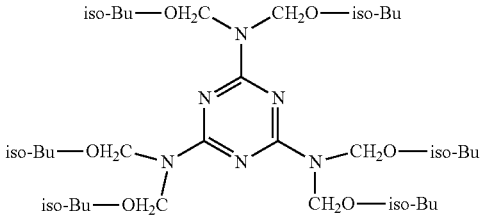
-continued
(C1-8)
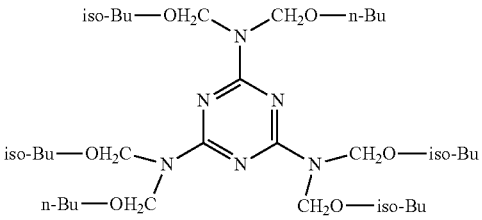
(C1-9)
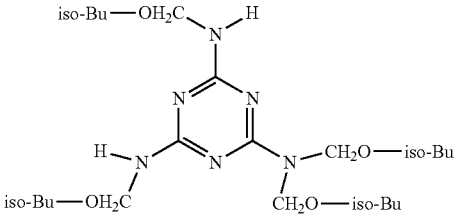
(C1-10)
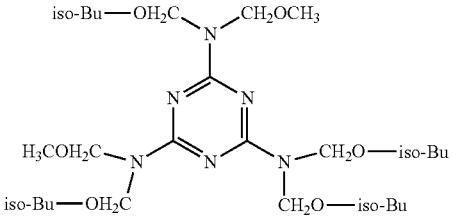
(C1-11)
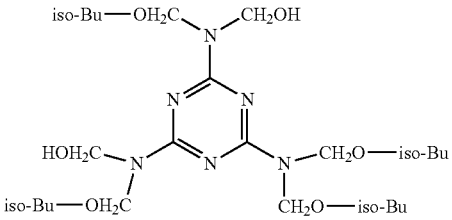
(C1-12)
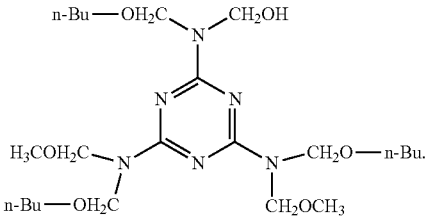
Hereinafter, as specific examples of the compound represented by the formula (C2), compounds represented by the following formulae (C2-1) to (C2-18) are shown.
(C2-1)
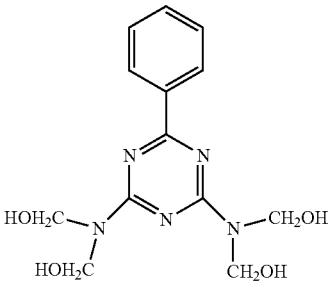

-continued
(C2-2)
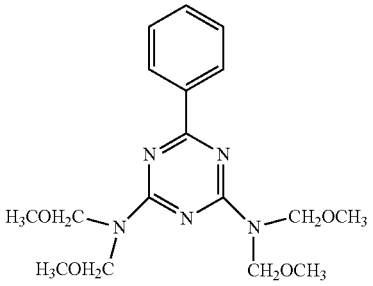
(C2-3)
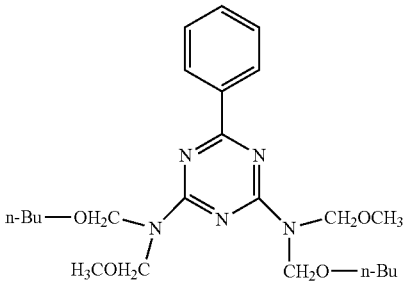
(C2-4)
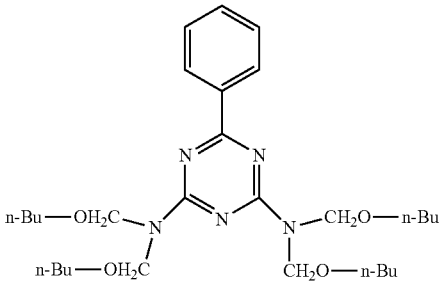
(C2-5)
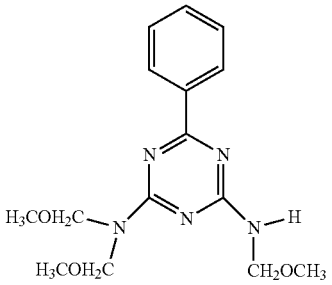
(C2-7)
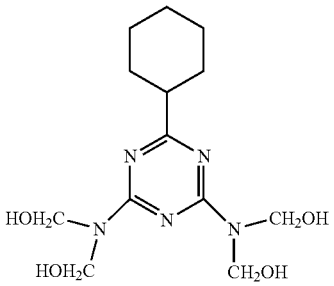
-continued
(C2-8)
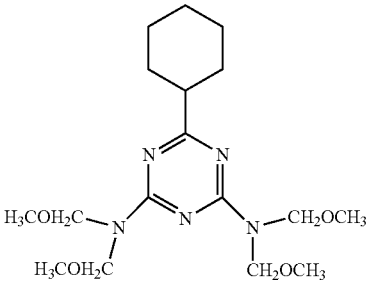
(C2-9)
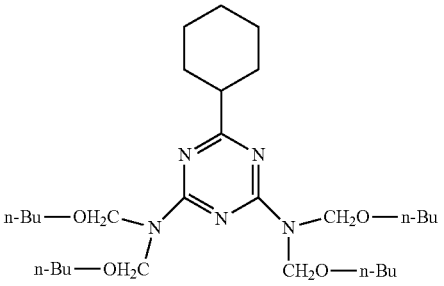
(C2-10)
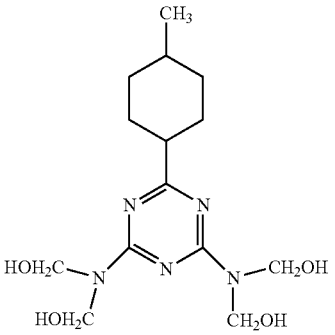
(C2-11)
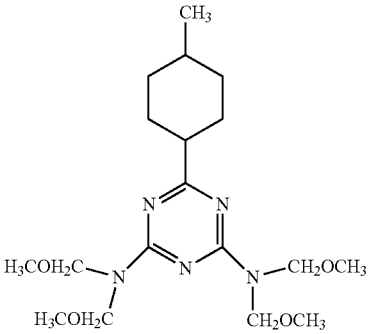
(C2-12)
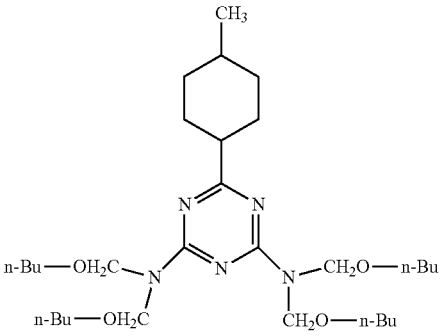

-continued
(C2-13)
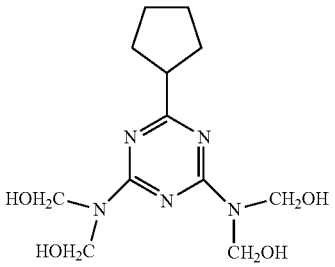
(C2-14)
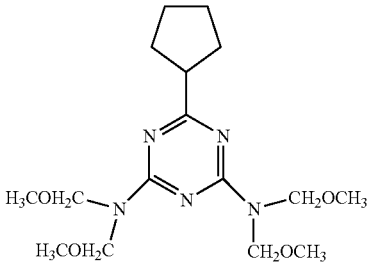
(C2-15)
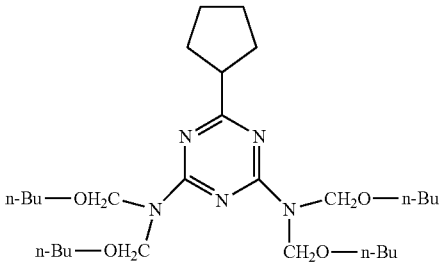
(C2-16)
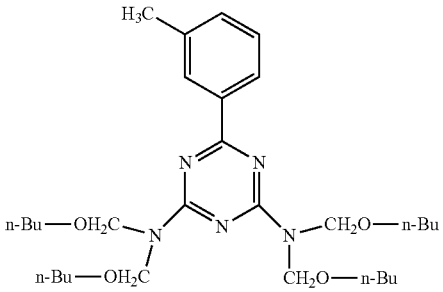
(C2-17)
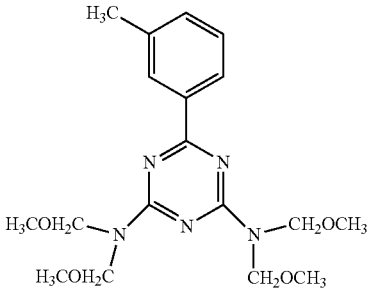
-continued
(C2-18)
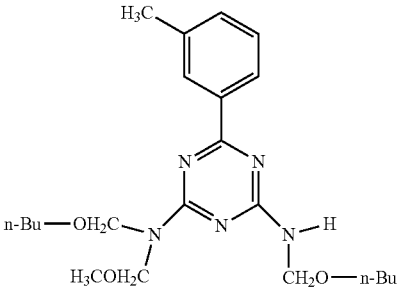
Hereinafter, as specific examples of the compound represented by the formula (C3), compounds represented by the following formulae (C3-1) to (C3-6) are shown.
(C3-1)
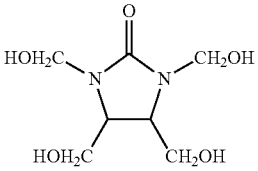
(C3-2)
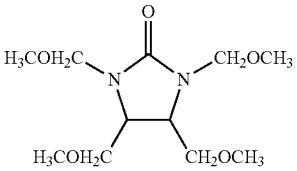
(C3-3)
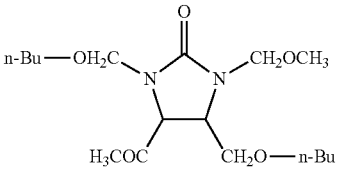
(C3-4)
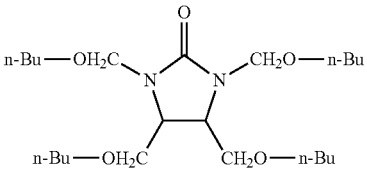
(C3-5)
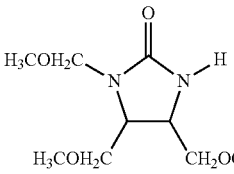
(C3-6)
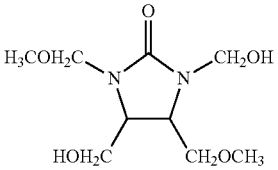
Hereinafter, as specific examples of the compound represented by the formula (C4), compounds represented by the following formulae (C4-1) to (C4-6) are shown.

(C4-1)

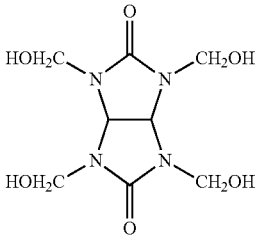

(C4-2)

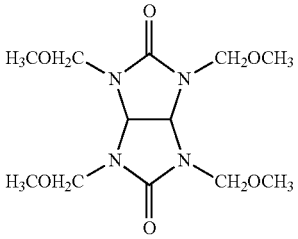

(C4-3)

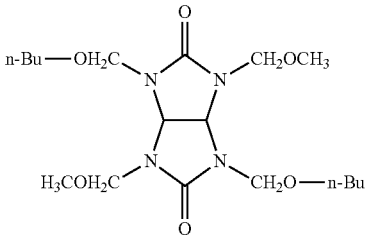

(C4-4)

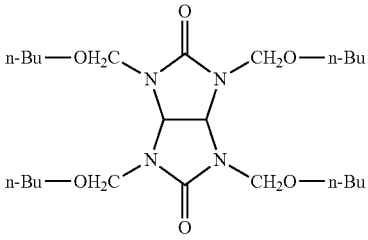

(C4-5)

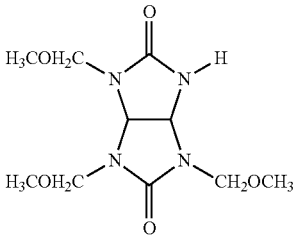

(C4-6)

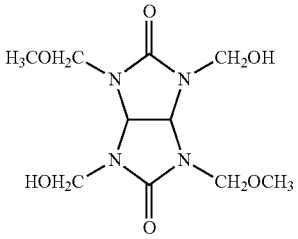

Hereinafter, as specific examples of the compound represented by the formula (C5), compounds represented by the following formulae (C5-1) to (C5-6) are shown.

(C5-1)

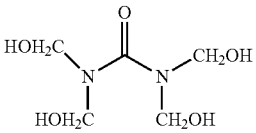

(C5-2)

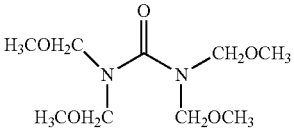

(C5-3)

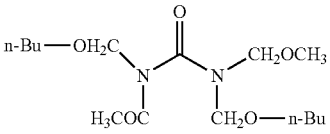

(C5-4)

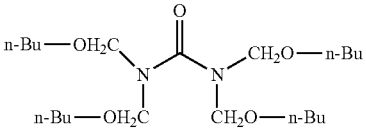

(C5-5)

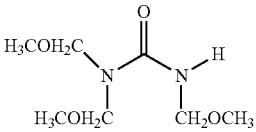

(C5-6)

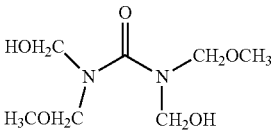

[Resin]

Then, the resin having a polymerizable functional group is described. The resin having a polymerizable functional group includes a resin having a structural unit represented by the following formula (D).

(D)

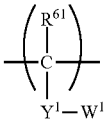

In the formula (D), $R^{61}$ represents a hydrogen atom or an alkyl group, $Y^1$ represents a single bond, an alkylene group or a phenylene group, and $W^1$ represents a hydroxy group, a thiol group, an amino group, a carboxyl group or a methoxy group.

Examples of the resin having the structural unit represented by the formula (D) include an acetal resin, a polyolefin resin, a polyester resin, a polyether resin, a polyamide resin and a cellulose resin. Such resins have the following characteristic structure in the structural unit represented by the formula (D) or other than the structural unit represented by the formula (D). The characteristic structure is shown in (E-1) to (E-6) below. (E-1) is a structural unit of an acetal resin. (E-2) is a structural unit of a polyolefin resin. (E-3) is a structural unit of a polyester resin. (E-4) is a structural unit of a polyether resin. (E-5) is a structural unit of a polyamide resin. (E-6) is a structural unit of a cellulose resin.

(E-1)

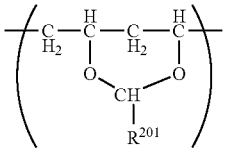

(E-2)

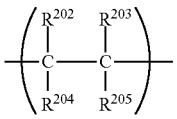

(E-3)

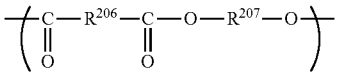

(E-4)

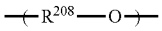

(E-5)

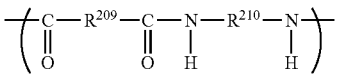

(E-6)

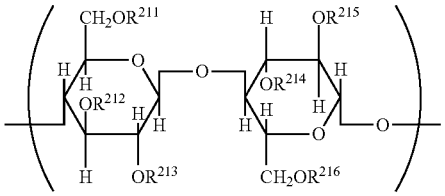

$R^{201}$ to $R^{205}$ each independently represent a hydrogen atom, or a substituted or unsubstituted alkyl group, or a substituted or unsubstituted aryl group. $R^{206}$ to $R^{210}$ each independently represent a substituted or unsubstituted alkylene group, or a substituted or unsubstituted arylene group. When $R^{201}$ represents $C_3H_7$, the site is designated as butyral. $R^{211}$ to $R^{216}$ represent an acetyl group, a hydroxyethyl group, a hydroxypropyl group or a hydrogen atom.

The resin having the structural unit represented by the formula (D) (hereinafter, also referred to as "resin D") can be obtained by polymerizing a monomer having a polymerizable functional group, which can be purchased from, for example, Sigma-Aldrich Japan K.K. or Tokyo Chemical Industry Co., Ltd.

Examples of the resin that can be purchased include polyether polyol resins such as AQD-457 and AQD-473 produced by Nippon Polyurethane Industry Co., Ltd., and Sunnix GP-400 and GP-700 produced by Sanyo Chemical Industries, Ltd.; polyester polyol resins such as Phthalkid W2343 produced by Hitachi Chemical Co., Ltd., Watersol S-118 as well as CD-520 and Beckolite M-6402-50 and M-6201-40IM produced by DIC Corporation, Haridip WH-1188 produced by Harima Chemicals Group, Inc., and ES3604 and ES6538 produced by Japan Upica Co., Ltd.; polyacryl polyol resins such as Burnock WE-300 and WE-304 produced by DIC Corporation; polyvinyl alcohol resins such as Kuraray Poval PVA-203 produced by Kuraray Co., Ltd.; polyvinyl acetal resins such as BX-1 and BM-1 produced by Sekisui Chemical Co., Ltd.; polyamide resins such as Toresin FS-350 produced by Nagase ChemteX Corporation; carboxyl group-containing resins such as Aqualic produced by Nippon Shokubai Co., Ltd. and Finelex SG2000 produced by Namariichi Co., Ltd.; polyamine resins such as Rackamide produced by DIC Corporation; and polythiol resins such as QE-340M produced by Toray Industries, Inc. In particular, polyvinyl acetal resins and polyester polyol resins can be adopted from the viewpoints of polymerizing property and the uniformity of an undercoat layer (first intermediate layer).

The weight average molecular weight (Mw) of the resin D can be 5000 to 400000.

The method for quantitatively measuring the polymerizable functional group in the resin includes the following: titration of a carboxyl group using potassium hydroxide, titration of an amino group using sodium nitrite, titration of a hydroxy group using acetic anhydride and potassium hydroxide, and titration of a thiol group using 5,5'-dithiobis (2-nitrobenzoic acid), as well as a calibration curve method using IR spectra of samples in which the rate of the polymerizable functional group introduced is varied.

Hereinafter, Table 12 shows specific examples of the resin D. In Table 12, a structural unit represented by any of (E-1) to (E-6) is shown in the column "characteristic structure". In Table 12, Ph represents a phenylene group. In the present invention, the weight average molecular weight of a resin means a weight average molecular weight in terms of polystyrene measured by a usual method, specifically, a method described in Japanese Patent Application Laid-Open No. 2007-79555.

TABLE 12

| | Structure | | | Molar number of functional | Characteristic | Substituent of characteristic | Weight average molecular |
|---|---|---|---|---|---|---|---|
| | $R^{61}$ | $Y^1$ | $W^1$ | group per g | structure | structure | weight |
| D1 | H | Single bond | OH | 3.3 mmol | Butyral | $R^{201} = C_3H_7$ | $1 \times 10^5$ |
| D2 | H | Single bond | OH | 3.3 mmol | Butyral | $R^{201} = C_3H_7$ | $4 \times 10^4$ |
| D3 | H | Single bond | OH | 3.3 mmol | Butyral | $R^{201} = C_3H_7$ | $2 \times 10^4$ |
| D4 | H | Single bond | OH | 1.0 mmol | Polyolefin | $R^{202}$ to $R^{205}$ = H | $1 \times 10^5$ |
| D5 | H | Single bond | OH | 3.0 mmol | Polyester | $R^{206} = R^{207} = C_2H_4$ | $8 \times 10^4$ |
| D6 | H | Single bond | OH | 2.5 mmol | Polyether | $R^{208} = C_4H_8$ | $5 \times 10^4$ |
| D7 | H | Single bond | OH | 2.1 mmol | Polyether | $R^{208} = C_4H_8$ | $2 \times 10^5$ |
| D8 | H | Single bond | COOH | 3.5 mmol | Polyolefin | $R^{202}$ to $R^{205}$ = H | $6 \times 10^4$ |
| D9 | H | Single bond | $NH_2$ | 1.2 mmol | Polyamide | $R^{209} = C_{10}H_{20}$, $R^{210} = C_6H_{12}$ | $2 \times 10^5$ |
| D10 | H | Single bond | SH | 1.3 mmol | Polyolefin | $R^{202}$ to $R^{205}$ = H | $9 \times 10^3$ |
| D11 | H | Phenylene | OH | 2.8 mmol | Polyolefin | $R^{202}$ to $R^{205}$ = H | $4 \times 10^3$ |
| D12 | H | Single bond | OH | 3.0 mmol | Butyral | $R^{201} = C_3H_7$ | $7 \times 10^4$ |
| D13 | H | Single bond | OH | 2.9 mmol | Polyester | $R^{206}$ = Ph, $R^{207} = C_2H_4$ | $2 \times 10^4$ |
| D14 | H | Single bond | OH | 2.5 mmol | Polyester | $R^{206} = R^{207} = C_2H_4$ | $6 \times 10^3$ |
| D15 | H | Single bond | OH | 2.7 mmol | Polyester | $R^{206} = R^{207} = C_2H_4$ | $8 \times 10^4$ |
| D16 | H | Single bond | COOH | 1.4 mmol | Polyolefin | $R^{202}$ to $R^{204}$ = H, $R^{205} = CH_3$ | $2 \times 10^5$ |

TABLE 12-continued

| | Structure | | | Molar number of functional | Characteristic | Substituent of characteristic | Weight average molecular |
|---|---|---|---|---|---|---|---|
| | $R^{61}$ | $Y^1$ | $W^1$ | group per g | structure | structure | weight |
| D17 | H | Single bond | COOH | 2.2 mmol | Polyester | $R^{206}$ = Ph, $R^{207}$ = $C_2H_4$ | $9 \times 10^3$ |
| D18 | H | Single bond | COOH | 2.8 mmol | Polyester | $R^{206}$ = $R^{207}$ = $C_2H_4$ | $8 \times 10^2$ |
| D19 | $CH_3$ | $CH_2$ | OH | 1.5 mmol | Polyester | $R^{206}$ = $R^{207}$ = $C_2H_4$ | $2 \times 10^4$ |
| D20 | $C_2H_5$ | $CH_2$ | OH | 2.1 mmol | Polyester | $R^{206}$ = $R^{207}$ = $C_2H_4$ | $1 \times 10^4$ |
| D21 | $C_2H_5$ | $CH_2$ | OH | 3.0 mmol | Polyester | $R^{206}$ = $R^{207}$ = $C_2H_4$ | $5 \times 10^4$ |
| D22 | H | Single bond | $OCH_3$ | 2.8 mmol | Polyolefin | $R^{202}$ to $R^{205}$ = H | $7 \times 10^3$ |
| D23 | H | Single bond | OH | 3.3 mmol | Butyral | $R^{201}$ = $C_3H_7$ | $2.7 \times 10^5$ |
| D24 | H | Single bond | OH | 3.3 mmol | Butyral | $R^{201}$ = $C_3H_7$ | $4 \times 10^5$ |
| D25 | H | Single bond | OH | 2.5 mmol | Acetal | $R^{201}$ = H | $3.4 \times 10^5$ |
| D26 | H | Single bond | OH | 2.8 mmol | Cellulose | $R^{211}$ = $R^{216}$ = $COCH_3$, $R^{212}$ to $R^{215}$ = H | $3 \times 10^4$ |

The thickness of the first intermediate layer is preferably 0.1 μm or more and 1.5 μm or less, more preferably 0.2 μm or more and 0.8 μm or less thickness, from the viewpoint that retention of electrons is suppressed to result in a further improvement in pattern memory.

In addition, the first intermediate layer may also contain a surface roughness imparting particle as an additive. The surface roughness imparting particle includes a curable resin particle, and an inorganic fine particle such as a silica particle or a metal oxide particle. In addition, the first intermediate layer may also contain additives such as a silicone oil, a surfactant and a silane compound.

Examples of the solvent for use in the first intermediate layer coating liquid include alcohol solvents, aromatic hydrocarbon solvents, halogenated hydrocarbon solvents, ketone solvents, ketone alcohol solvents, ether solvents and ester solvents.

The first intermediate layer is provided directly on the support. The first intermediate layer is provided directly on the support to thereby inhibit injection of holes from the support from causing the deterioration in electron transporting property and retention of electrons.

[Second Intermediate Layer]

The second intermediate layer contains a binder resin and a metal oxide particle.

Examples of the binder resin include a phenol resin, a polyurethane resin, a polyamide resin, a polyimide resin, a polyamideimide resin, a polyvinyl acetal resin, an epoxy resin, an acrylic resin, an alkyd-melamine resin and a polyester resin. Such resins can be used singly or in combination of two or more. Among the binder resins, a curable resin is preferable from the viewpoints of resistance to a solvent in a coating liquid for use in formation of another layer and dispersibility or dispersion stability of the metal oxide particle. A thermosetting resin is more preferable. Examples of the thermosetting resin include a thermosetting phenol resin, a thermosetting polyurethane resin and an alkyd-melamine resin. Among the thermosetting resins, an alkyd-melamine resin can be adopted. When the alkyd-melamine resin is used, the ratio of the content of the alkyd resin to the content of the melamine resin can be in the range from 1/1 to 4/1 on the mass basis.

Examples of the metal oxide particle include particles of zinc oxide, lead white, aluminum oxide, indium oxide, silicon oxide, zirconium oxide, tin oxide, titanium oxide, magnesium oxide, antimony oxide, bismuth oxide, indium oxide doped with tin, and tin oxide doped with antimony or tantalum. Among the particles, a titanium oxide particle and a zinc oxide particle are preferable. In particular, a titanium oxide particle, which hardly absorbs visible light and near-infrared light and is white, is preferable from the viewpoints of prevention of an interference fringe and the increase in sensitivity. Two or more of the metal oxide particles may be selected and used in combination. Examples of the crystal type of titanium oxide include a rutile type, an anatase type, a brookite type and an amorphous type, and any of the types may be used. A needle crystal or granular crystal titanium oxide particle may be used. The particle of a rutile type titanium oxide crystal is more preferable.

The number average primary particle diameter of the metal oxide particle is preferably 0.03 μm or more and 1.0 μm or less, more preferably 0.1 μm or more and 0.5 μm or less.

From the viewpoint of further suppressing the pattern memory, the content of the metal oxide particle in the second intermediate layer is preferably 50% by mass or more and 75% by mass or less, more preferably 60% by mass or more and 75% by mass or less based on the total mass of the second intermediate layer.

The second intermediate layer can be formed by coating the first intermediate layer with a second intermediate layer coating liquid containing a solvent, the binder resin and the metal oxide particle to form a coating film, and drying and/or curing the resulting coating film.

The second intermediate layer coating liquid can be prepared by dispersing the metal oxide particle together with the binder resin in the solvent. Examples of the dispersion method include a method using a paint shaker, a sand mill, a ball mill or a liquid-collision type high-speed disperser.

An agent required for curing (crosslinking), a solvent, an additive, a curing accelerator and the like can also be added to the second intermediate layer coating liquid as needed.

In order to suppress the occurrence of an interference fringe, the second intermediate layer may also contain a surface roughness imparting material. The surface roughness imparting material can be a resin particle having a number average particle diameter of 1 μm or more and 5 μm or less. Examples of the resin particle include particles of a curable rubber, polyurethane, an epoxy resin, an alkyd resin, a phenol resin, polyester, a silicone resin and an acrylic-melamine resin.

The thickness of the second intermediate layer is preferably 1 μm or more and 10 μm or less, more preferably 2 μm or more and 6 μm or less.

In order to further suppress the pattern memory, the content (% by mass) of the electron transporting substance having a polymerizable functional group in the composition of the first intermediate layer is preferably 0.4 times or more the content (% by mass) of a metal oxide particle in the total amount of the second intermediate layer. When the content is 0.4 times or more, injection of electrons and electron transporting property from the second intermediate layer to the first intermediate layer are further improved to further suppress the pattern memory. More preferably, the content is 0.4 times or more and 1 time or less.

[Support]

As the support, for example, a support formed by a metal such as aluminum, nickel, copper, gold or iron, or an alloy of such metals can be used. In addition, examples include a support in which a thin film made of a metal such as aluminum, silver or gold, or a thin film made of an electroconductive material such as indium oxide or tin oxide is formed on an insulating support made of a polyester resin, a polycarbonate resin, a polyimide resin or glass. The surface of an electroconductive support may be subjected to an electrochemical treatment such as anodization, a wet horning treatment, a blasting treatment or a cutting treatment for the purposes of the improvement in electrical properties and the suppression of an interference fringe.

[First Intermediate Layer, Second Intermediate Layer]

The first intermediate layer and the second intermediate layer are described above.

[Charge Generating Layer]

The charge generating layer is formed on the second intermediate layer.

The charge generating substance for use in the charge generating layer include an azo pigment, a perylene pigment, an anthraquinone derivative, an anthanthrone derivative, a dibenzpyrenequinone derivative, a pyranthrone derivative, a violanthrone derivative, an isoviolanthrone derivative, an indigo derivative, a thioindigo derivative, a phthalocyanine pigment and a bisbenzimidazole derivative. In particular, an azo pigment and a phthalocyanine pigment can be adopted. With respect to the phthalocyanine pigment, oxytitanium phthalocyanine, chlorogallium phthalocyanine and hydroxy gallium phthalocyanine can be adopted.

Examples of the binder resin for use in the charge generating layer include polymers and copolymers of vinyl compounds such as styrene, vinyl acetate, vinyl chloride, acrylate, methacrylate, vinylidene fluoride and trifluoroethylene, and a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicone resin and an epoxy resin. In particular, a polyester resin, a polycarbonate resin and a polyvinyl acetal resin are preferable, and a polyvinyl acetal resin is more preferable.

The charge generating layer can be formed by dispersing the charge generating substance together with the binder resin and the solvent to provide a charge generating layer coating liquid, forming a coating film of the coating liquid, and drying the resulting coating film. The charge generating layer may also be a deposited film of the charge generating substance.

The mass ratio of the charge generating substance to the binder resin in the charge generating layer (charge generating substance/binder resin) is preferably in the range from 10/1 to 1/10, more preferably in the range from 5/1 to 1/5. The solvent for use in the charge generating layer coating liquid include alcohol solvents, sulfoxide solvents, ketone solvents, ether solvents, ester solvents and aromatic hydrocarbon solvents.

The thickness of the charge generating layer can be 0.05 μm or more and 5 μm or less.

[Hole Transporting Layer]

The hole transporting layer is formed on the charge generating layer.

The hole transporting substance for use in the hole transporting layer includes a polycyclic aromatic compound, a heterocyclic compound, a hydrazone compound, a styryl compound, a benzidine compound, a triarylamine compound and triphenylamine. Alternatively, the hole transporting substance includes polymers having groups derived from those compounds in the main chain or the side chain. In particular, a triarylamine compound, a benzidine compound and a styryl compound can be adopted.

Examples of the binder resin for use in the hole transporting layer include a polyester resin, a polycarbonate resin, a polymethacrylate resin, a polyarylate resin, a polysulfone resin and a polystyrene resin. In particular, a polycarbonate resin and a polyarylate resin can be adopted. The molecular weight of such a resin can be as follows: weight average molecular weight (Mw)=10,000 to 300,000.

The mass ratio of the hole transporting substance to the binder resin in the hole transporting layer (hole transporting substance/binder resin) is preferably 10/5 to 5/10, more preferably 10/8 to 6/10.

The thickness of the hole transporting layer is preferably 3 μm or more and 40 μm or less, more preferably 5 μm or more and 16 μm or less. The solvent for use in a hole transporting layer coating liquid includes alcohol solvents, sulfoxide solvents, ketone solvents, ether solvents, ester solvents or aromatic hydrocarbon solvents.

A protective layer may also be formed on the hole transporting layer. The protective layer can contain an electroconductive particle or the charge transporting substance, and the binder resin. The protective layer can further contain an additive such as a lubricant. The binder resin itself of the protective layer may have electroconductivity and charge transporting property, and in such a case, the protective layer may contain no electroconductive particle and no charge transporting substance, in addition to the binder resin. The binder resin of the protective layer may be a thermoplastic resin, or a curable resin to be polymerized by heat, light or radiation (electron beam). The thickness of the protective layer can be 1 μm or more and 10 μm or less.

The method for forming each of the layers can be a method including dissolving and/or dispersing a material for forming each layer in each solvent to provide a coating liquid, forming a coating film by coating with the coating liquid, and drying and/or curing the resulting coating film. Examples of the coating method of the coating liquid include a dip coating method, a spray coating method, a curtain coating method and a spin coating method.

[Process Cartridge and Electrophotographic Apparatus]

FIG. 1 illustrates a schematic configuration of an electrophotographic apparatus having a process cartridge provided with the electrophotographic photosensitive member.

The electrophotographic apparatus illustrated in FIG. 1 has a cylindrical electrophotographic photosensitive member 1 which is rotatably driven at a predetermined peripheral velocity around a shift 2 in the arrow direction. The surface (periphery) of the electrophotographic photosensitive member 1 rotatably driven is uniformly charged at a predetermined positive or negative potential by a charging unit 3 (primary charging unit: charging roller). Then, the surface of the electrophotographic photosensitive member 1, uniformly charged, is exposed to exposure light (image exposure light) 4 from an exposing unit (not illustrated) such as slit exposure or laser beam scanning exposure. Thus, an electrostatic latent image corresponding to an intended image is formed on the surface of the electrophotographic photosensitive member 1.

The electrostatic latent image formed on the surface of the electrophotographic photosensitive member 1 is developed by a toner included in a developer of a developing unit 5 to form a toner image. Then, the toner image formed on the surface of the electrophotographic photosensitive member 1 is sequentially transferred to a transfer material (paper) P by a transfer bias from a transfer unit (transfer roller) 6. Herein, the transfer material P is taken out from a transfer material feeding unit (not illustrated) and fed to a gap (abutting portion) between the electrophotographic photosensitive member 1 and the transfer unit 6 in synchronization with rotation of the electrophotographic photosensitive member 1.

The transfer material P to which the toner image is transferred is separated from the surface of the electrophotographic photosensitive member 1, introduced to a fixing unit 8 to be subjected to image fixing, and conveyed as an image-formed product (print, copy) outside the apparatus.

The surface of the electrophotographic photosensitive member 1 after the toner image is transferred is subjected to removal of a transfer residual developer (transfer residual toner) by a cleaning unit (cleaning blade) 7 to be cleaned. Then, the surface of the electrophotographic photosensitive member 1, cleaned, is subjected to an antistatic treatment by pre-exposure light (not illustrated) from a pre-exposure unit (not illustrated), and then repeatedly used for image formation. Herein, when the charging unit 3 is a contact charging unit using a charging roller, as illustrated in FIG. 1, such pre-exposure light is not necessarily required.

Among elements including the electrophotographic photosensitive member 1, the charging unit 3, the developing unit 5 and the cleaning unit 7, a plurality of elements are selected, accommodated in a container, and integrally supported as a process cartridge. Thus, the process cartridge can be configured to be attachable to and detachable from the main body of an electrophotographic apparatus such as a copier or a laser beam printer. In FIG. 1, the electrophotographic photosensitive member 1 is integrally supported together with the charging unit 3, the developing unit 5 and the cleaning unit 7 to be formed into a cartridge, and the cartridge is used as a process cartridge 9 attachable to and detachable from the main body of the electrophotographic apparatus using a guide unit 10 such as a rail for the main body of the electrophotographic apparatus.

EXAMPLES

Hereinafter, the present invention is described in more detail with reference to Examples and Comparative Examples. The present invention, however, is not limited to the following Examples at all. Herein, "part(s)" in Examples and Comparative Examples means "part(s) by mass".

Synthesis Example 1

1,4,5,8-Naphthalenetetracarboxylic dianhydride (26.8 g, 100 mmol), and 150 ml of dimethylacetamide were added to a 300-ml three-necked flask at room temperature under a nitrogen stream. A mixture of 8.9 g (100 mmol) of butanolamine and 25 ml of dimethylacetamide was dropped thereto with stirring. After completion of the dropping, the mixture was heated under reflux for 6 hours. After completion of the heating under reflux, the flask was cooled and the content thereof was concentrated under reduced pressure. Ethyl acetate was added to the residue, and the resultant was subjected to purification by silica gel column chromatography. Furthermore, a purified product was re-crystallized by ethyl acetate/hexane to provide 10.2 g of a monoimide in which a butanol structure was introduced to only one side.

A 300-ml three-necked flask was loaded with 6.8 g (20 mmol) of the monoimide, 1 g (20 mmol) of hydrazine monohydrate, 10 mg of p-toluenesulfonic acid and 50 ml of toluene, and the resultant was heated under reflux for 5 hours. After completion of the heating under reflux, the flask was cooled and the content thereof was concentrated under reduced pressure. The residue was subjected to purification by silica gel column chromatography. Furthermore, a purified product was re-crystallized by toluene/ethyl acetate to provide 2.54 g of a compound (electron transporting substance) represented by exemplary compound (A1101).

Synthesis Example 2

In 500-ml three-necked flask, 23.4 g (100 mmol) of a compound represented by the following formula (X-1) and 15.2 g (100 mmol) of a compound represented by the following formula (X-2) were dissolved in 200 ml of tetrahydrofuran at room temperature under a nitrogen stream. Then, the resultant was heated to 60° C., and then heated under reflux for 6 hours. After completion of the heating under reflux, the flask was cooled, then the reaction liquid was filtered, and the filtrate was concentrated to provide 30 g of a crude crystal. The resulting crystal was re-crystallized by acetone, and dried under reduced pressure to provide 25.8 g of a compound represented by the following formula (X-3). Herein, as the compound represented by the formula (X-1), 3,5-di-tert-butyl-4-hydroxybenzaldehyde produced by Tokyo Chemical Industry Co., Ltd. was used. As the compound represented by the formula (X-2), 4-hydrazinobenzoic acid produced by Sigma-Aldrich Japan K.K. was used.

Then, in a 500-ml three-necked flask, 23.2 g (63 mmol) of the compound represented by the formula (X-3) was dissolved in 200 ml of chloroform, and then 18.5 g (117 mmol) of potassium permanganate was added thereto. The resultant was heated to 52° C., and then stirred at the temperature for 5 hours. The reaction liquid was filtered, and the filtrate was concentrated to provide 25.6 g of a crude crystal. The resulting crystal was re-crystallized by acetone, and dried under reduced pressure to provide 22.0 g of a compound represented by the following formula (X-4).

In a 500-ml three-necked flask, 18.3 g (50 mmol) of the compound represented by formula (X-4) was dissolved in 200 ml of tetrahydrofuran, and 1.89 g (50 mmol) of sodium boron hydride and 11.7 g (50 mmol) of zirconium chloride were then added thereto. The resultant was heated to 52° C., and then stirred at the temperature for 5 hours. The reaction liquid was filtered, and the filtrate was concentrated to provide 15.3 g of a crude crystal. The resulting crystal was re-crystallized by acetone, and dried under reduced pressure to provide 14.1 g of exemplary compound (A1001).

(X-1)

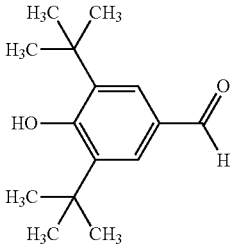

(X-2)

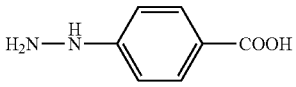

(X-3)

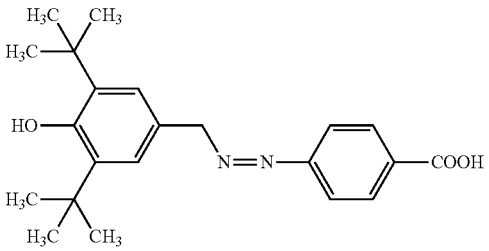

(X-4)

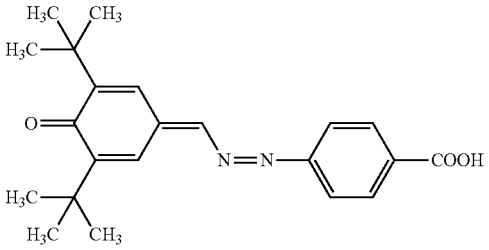

(A1001)

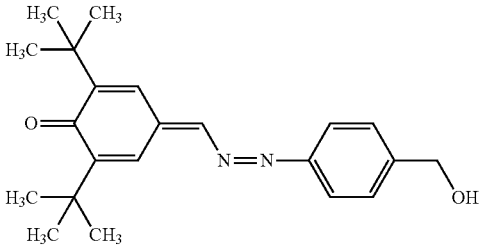

(Second Intermediate Layer Coating Liquid 1)

Eighty-four parts of a titanium oxide particle (CR-EL, produced by Ishihara Sangyo Kaisha Ltd.), 33.6 parts of an alkyd resin (Beckolite M-6401-50-S, solid content: 50%, produced by DIC Corporation) and 18.7 parts of a melamine resin (Super Beckamine G-821-60, solid content: 60%, produced by DIC Corporation) were mixed with a solvent of 100 parts of methyl ethyl ketone. The solution was subjected to dispersion in a sand mill apparatus with glass beads having a diameter of 1 mm for 3 hours to prepare second intermediate layer coating liquid 1.

(Second Intermediate Layer Coating Liquid 2)

Seventy-eight parts of a titanium oxide particle (CR-EL), 40 parts of an alkyd resin (Beckolite M-6401-50-S) and 22 parts of a melamine resin (Super Beckamine G-821-60) were mixed with a solvent of 100 parts of methyl ethyl ketone. The solution was subjected to dispersion in a sand mill apparatus with glass beads having a diameter of 1 mm for 3 hours to prepare second intermediate layer coating liquid 2.

(Second Intermediate Layer Coating Liquid 3)

Seventy-one parts of a titanium oxide particle (CR-EL), 47 parts of an alkyd resin (Beckolite M-6401-50-S) and 26 parts of a melamine resin (Super Beckamine G-821-60) were mixed with a solvent of 100 parts of methyl ethyl ketone. The solution was subjected to dispersion in a sand mill apparatus with glass beads having a diameter of 1 mm for 3 hours to prepare second intermediate layer coating liquid 3.

(Second Intermediate Layer Coating Liquid 4)

Sixty-seven parts of a titanium oxide particle (CR-EL), 55 parts of an alkyd resin (Beckolite M-6401-50-S) and 35 parts of a melamine resin (Super Beckamine G-821-60) were mixed with a solvent of 100 parts of methyl ethyl ketone. The solution was subjected to dispersion in a sand mill apparatus with glass beads having a diameter of 1 mm for 3 hours to prepare second intermediate layer coating liquid 4.

(Second Intermediate Layer Coating Liquid 5)

Second intermediate layer coating liquid 5 was prepared in the same manner as in second intermediate layer coating liquid 1 except that 84 parts of the titanium oxide particle (CR-EL) was changed to 42 parts of the titanium oxide particle (CR-EL) and 42 parts of a titanium oxide particle (PT-401M, produced by Ishihara Sangyo Kaisha Ltd.) in second intermediate layer coating liquid 1.

(Second Intermediate Layer Coating Liquid 6)

Second intermediate layer coating liquid 6 was prepared in the same manner as in second intermediate layer coating liquid 1 except that 84 parts of the titanium oxide particle (CR-EL) was changed to 84 parts of a zinc oxide particle (produced by Tayca, average particle diameter: 70 nm, specific surface area: 15 $m^2/g$) in second intermediate layer coating liquid 1.

(Second Intermediate Layer Coating Liquid 7)

Second intermediate layer coating liquid 7 was prepared in the same manner as in second intermediate layer coating liquid 3 except that 71 parts of the titanium oxide particle (CR-EL) was changed to 71 parts of a zinc oxide particle (produced by Tayca, average particle diameter: 70 nm, specific surface area: 15 $m^2/g$) in second intermediate layer coating liquid 3.

(Second Intermediate Layer Coating Liquid 8)

Eighty-four parts of a titanium oxide particle (CR-EL) and 38 parts of a block isocyanate resin (Burnock DB-980K (solid content: 75%), produced by DIC Corporation) were mixed with a solvent of 100 parts of methyl ethyl ketone. The solution was subjected to dispersion in a sand mill apparatus with glass beads having a diameter of 1 mm for 3 hours to prepare second intermediate layer coating liquid 8.

(Second Intermediate Layer Coating Liquid 9)

Eighty-four parts of a titanium oxide particle (CR-EL) and 28.5 parts of an N-methoxymethylated nylon resin (FR-101, produced by Namariichi Co., Ltd.) were mixed with a solvent of 70 parts of methanol and 30 parts of n-butanol. The solution was subjected to dispersion in a sand mill apparatus with glass beads having a diameter of 1 mm for 3 hours to prepare second intermediate layer coating liquid 9.

Example 1

An aluminum cylinder having a diameter of 24 mm (JIS-A3003) was used as a support (electroconductive support).

Then, 9 parts of electron transporting substance (A114) having a polymerizable functional group, 16 parts of crosslinking agent (isocyanate compound having block isocyanate groups (B1:H1(protective group))), and 0.05 parts of a catalyst (dioctyl tin laurate) were dissolved in a mixed solvent of 100 parts of dimethylacetamide and 100 parts of methyl ethyl ketone to prepare a first intermediate layer coating liquid. The support was dip-coated with the first intermediate layer coating liquid, and the resulting coating film was heated at 160° C. for 40 minutes and cured (polymerized) to thereby form a first intermediate layer having a thickness of 0.5 μm. The content of the electron transporting substance based on the total mass of the composition (electron transporting substance and crosslinking agent) was 36% by mass.

Then, the first intermediate layer was coated with second intermediate layer coating liquid 1 to form a coating film, and the resulting coating film was dried (heat-cured) at 160° C. for 30 minutes to form a second intermediate layer having a thickness of 3.5 μm. The content of the metal oxide particle based on the total mass of the metal oxide particle and the resin was 75% by mass.

Thus, the first intermediate layer and the second intermediate layer were formed. Herein, the content of the electron transporting substance in the composition of the first intermediate layer was 0.48 times the content of the metal oxide particle based on the total mass of the second intermediate layer.

Then, a hydroxy gallium phthalocyanine crystal (charge generating substance) having a crystal form exhibiting peaks at Bragg angles (2θ±0.2°) of 7.5°, 9.9°, 12.5°, 16.3°, 18.6°, 25.1° and 28.3° in CuKα characteristic X-ray diffraction was prepared. A sand mill with glass beads having a diameter of 1 mm was loaded with 10 parts of the hydroxy gallium phthalocyanine crystal, 5 parts of a polyvinyl butyral resin (trade name: S-LEC BX-1, produced by Sekisui Chemical Co., Ltd.) and 250 parts of cyclohexanone, and the resultant was subjected to a dispersion treatment for 1.5 hours. Then, 250 parts of ethyl acetate was added thereto to prepare a charge generating layer coating liquid.

The second intermediate layer was dip-coated with the charge generating layer coating liquid to form a coating film, and the resulting coating film was dried at 95° C. for 10 minutes to form a charge generating layer having a thickness of 0.18 μm.

Then, 5 parts of a compound represented by the following formula (CTM-1), 5 parts of a compound represented by the following formula (CTM-2) and 10 parts of a polycarbonate resin having a structural unit represented by the following formula (B1-1) were dissolved in 50 parts of monochlorobenzene to prepare a hole transporting layer coating liquid. The charge generating layer was dip-coated with the hole transporting layer coating liquid to form a coating film, and the resulting coating film was dried at 120° C. for 30 minutes to form a hole transporting layer having a thickness of 20 μm. Thus, an electrophotographic photosensitive member of Example 1 was produced.

(CTM-1)

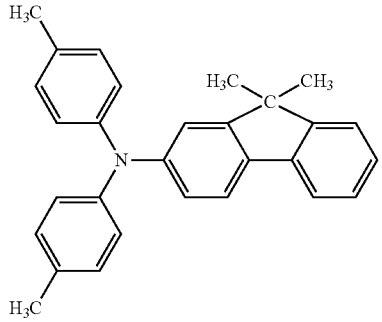

(CTM-2)

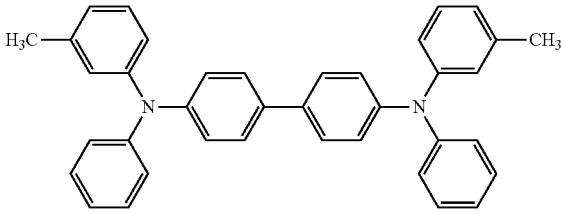

(B1-1)

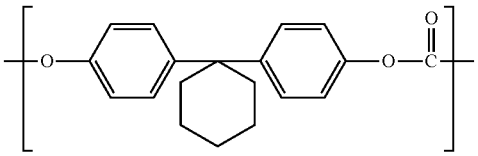

(Evaluation of Pattern Memory)

The electrophotographic photosensitive member produced in Example 1 for evaluation was mounted to a laser beam printer (trade name: LaserJet P2055dn) manufactured by Hewlett-Packard Company. The printer was disposed under a low-temperature and low-humidity (temperature 15° C./humidity 10% RH) environment, and a test was performed in which a vertical line pattern image of 3 dots and 100 spaces was continuously repeatedly output for 10000 sheets. Thereafter, a toner for the laser beam printer was resupplied, and a test was performed in which the pattern was continuously repeatedly output for additional 10000 sheets.

Figure 4:
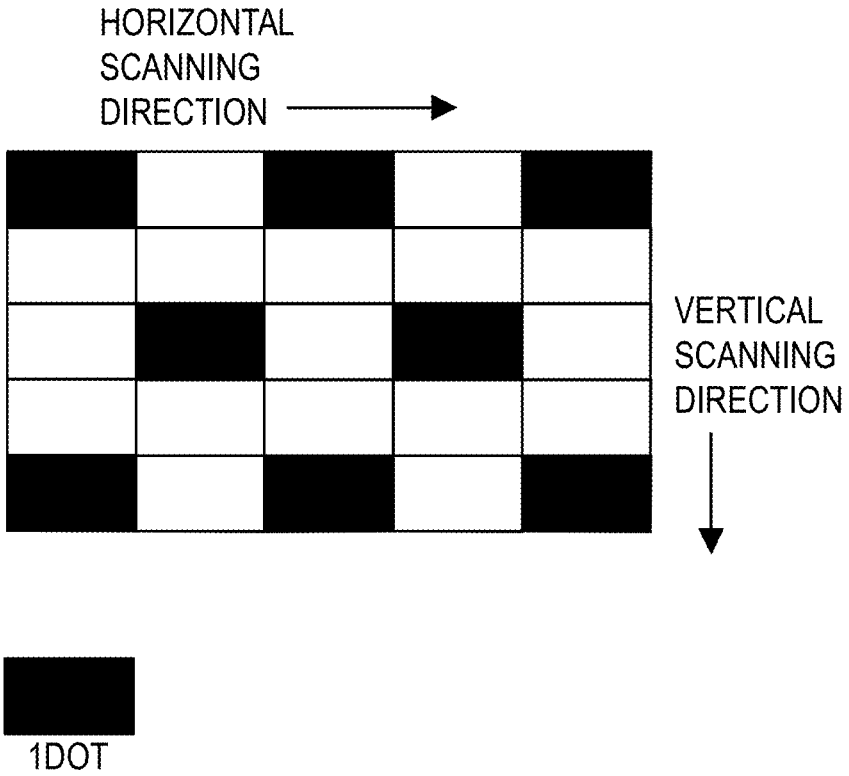
FIG. 4 is a view illustrating a one-dot, keima-jump pattern image.

Then, four kinds of halftone images and a solid black image were output as samples for image evaluation at the time of completion of the image outputting for 10000 sheets and at the time of completion of the image outputting for 20000 sheets. Depending on how a vertical streak due to the history of the vertical line on each of the four kinds of halftone images and the solid black image looked, and the degree of occurrence of the pattern memory was rated on a 6-point scale as shown in Table 13. As the degree of occurrence of the pattern memory is lower, the number of the rank is greater. Herein, the four kinds of halftone images are as follows: a halftone image of a one-dot, keima-jump pattern illustrated in FIG. 4, a lateral line halftone image of 1 dot and 1 space, a lateral line halftone image of 2 dots and 3 spaces, and a lateral line halftone image of 1 dot and 2 spaces.

TABLE 13

| | | Rank of pattern memory | | | | | |
|---|---|---|---|---|---|---|---|
| | | 6 | 5 | 4 | 3 | 2 | 1 |
| Solid black image | | Not observed | Observed | Observed | Observed | Observed | Observed |
| Halftone image | One-dot, keima jump pattern | Not observed | Not observed | Observed | Observed | Observed | Observed |
| | Lateral line of 1 dot and 1 space | Not observed | Not observed | Not observed | Observed | Observed | Observed |
| | Lateral line of 2 dots and 3 spaces | Not observed | Not observed | Not observed | Not observed | Observed | Observed |
| | Lateral line of 1 dot and 2 spaces | Not observed | Not observed | Not observed | Not observed | Not observed | Observed |

Examples 2 to 28, 36, 37, 39, 40, 42 and 43

Each electrophotographic photosensitive member was produced and evaluated in the same manner as in Example 1 except that with respect to the first intermediate layer and the second intermediate layer, the type and the content of the electron transporting substance and the crosslinking agent of the first intermediate layer, the type of the second intermediate layer coating liquid, the thickness of the first intermediate layer and the thickness of the second intermediate layer were changed as shown in Table 14. The results are shown in Table 14.

Example 29

An electrophotographic photosensitive member was produced and evaluated in the same manner as in Example 1 except that the first intermediate layer was formed as follows. The results are shown in Table 14.

Nine parts of electron transporting substance (A114), 16 parts of amine compound (C1-3) and 0.1 parts of a catalyst (dodecylbenzenesulfonic acid) were dissolved in a mixed solvent of 100 parts of dimethylacetamide and 100 parts of methyl ethyl ketone to prepare a first intermediate layer coating liquid. The support was dip-coated with the first intermediate layer coating liquid to form a coating film, and the resulting coating film was heated and cured at a temperature of 160° C. for 40 minutes to form a first intermediate layer having a thickness of 0.5 μm. The content of the electron transporting substance based on the total mass of the composition (electron transporting substance and crosslinking agent) was 36% by mass.

Examples 30 to 35, 38 and 41

Each electrophotographic photosensitive member was produced and evaluated in the same manner as in Example 29 except that with respect to the first intermediate layer and the second intermediate layer, the type and the content of the electron transporting substance and the crosslinking agent of the first intermediate layer, the type of the second intermediate layer coating liquid, the thickness of the first intermediate layer and the thickness of the second intermediate layer were changed as shown in Table 14. The results are shown in Table 14.

Example 44

An electrophotographic photosensitive member was produced and evaluated in the same manner as in Example 1 except that the first intermediate layer was formed as follows. The results are shown in Table 14.

Eight parts of electron transporting substance (A114), 13.7 parts of crosslinking agent (isocyanate compound having block isocyanate groups (B1:H1(protective group))), 3.3 parts of resin (D1) (in formula (E-1), $R^{201}$: propyl group) and 0.05 parts of a catalyst (dioctyl tin laurate) were dissolved in a mixed solvent of 100 parts of dimethylacetamide and 100 parts of methyl ethyl ketone to prepare a first intermediate layer coating liquid. The support was dip-coated with the first intermediate layer coating liquid to form a coating film, and the resulting coating film was heated and cured (polymerized) at a temperature of 160° C. for 40 minutes to form a first intermediate layer having a thickness of 0.5 μm. The content of the electron transporting substance based on the total mass of the composition (electron transporting substance, crosslinking agent and resin) was 32% by mass.

Example 45 to 62

Each electrophotographic photosensitive member was produced and evaluated in the same manner as in Example 44 except that with respect to the first intermediate layer and the second intermediate layer, the type and the content of the electron transporting substance, the crosslinking agent and the resin of the first intermediate layer, the type of the second intermediate layer coating liquid, the thickness of the first intermediate layer and the thickness of the second intermediate layer were changed as shown in Table 14. The results are shown in Table 14.

Example 63

An electrophotographic photosensitive member was produced and evaluated in the same manner as in Example 1 except that the first intermediate layer was formed as follows. The results are shown in Table 14.

Eleven parts of electron transporting substance (A114), 8.7 parts of amine compound (C1-3), 5 parts of resin (D1) and 0.1 parts of a catalyst (dodecylbenzenesulfonic acid) were dissolved in a mixed solvent of 100 parts of dimethylacetamide and 100 parts of methyl ethyl ketone to prepare a first intermediate layer coating liquid. The support was dip-coated with the first intermediate layer coating liquid to form a coating film, and the resulting coating film was heated and cured at a temperature of 160° C. for 40 minutes to form a first intermediate layer having a thickness of 0.5 μm. The content of the electron transporting substance based on the total mass of the composition (electron transporting substance, crosslinking agent and resin) was 45% by mass.

Example 64

An electrophotographic photosensitive member was produced and evaluated in the same manner as in Example 63 except that with respect to the first intermediate layer and the second intermediate layer, the type and the content of the electron transporting substance and the crosslinking agent of the first intermediate layer, the type of the second intermediate layer coating liquid, the thickness of the first intermediate layer and the thickness of the second intermediate layer were changed as shown in Table 14. The results are shown in Table 14.

Example 65

An electrophotographic photosensitive member was produced and evaluated in the same manner as in Example 1 except that the first intermediate layer was formed as follows. The results are shown in Table 14.

Eleven parts of electron transporting substance (A114), 8.7 parts of amine compound (C1-3), 5 parts of resin (D21) (in the formula (E-3), $R^{206}$: $(CH_2)_6$; $R^{207}$: $CH_2C(CH_3)_2CH_2$) and 0.1 parts of a catalyst (dodecylbenzenesulfonic acid) were dissolved in a mixed solvent of 100 parts of dimethylacetamide and 100 parts of methyl ethyl ketone to prepare a first intermediate layer coating liquid. The support was dip-coated with the first intermediate layer coating liquid to form a coating film, and the resulting coating film was heated and cured at a temperature of 160° C. for 40 minutes to form a first intermediate layer having a thickness of 0.5 μm. The content of the electron transporting substance based on the total mass of the composition (electron transporting substance, crosslinking agent and resin) was 45% by mass.

Examples 66 to 68

Each electrophotographic photosensitive member was produced and evaluated in the same manner as in Example 65 except that with respect to the first intermediate layer and the second intermediate layer, the types and the contents of the electron transporting substance, the crosslinking agent and the resin of the first intermediate layer, the type of the second intermediate layer coating liquid, the thickness of the first intermediate layer and the thickness of the second intermediate layer were changed as shown in Table 14. The results are shown in Table 14.

Example 69

An electrophotographic photosensitive member was produced and evaluated in the same manner as in Example 1 except that the first intermediate layer was formed as follows. Herein, the result of the pattern memory was rated as Rank 6 at the time of completion of the image outputting for 10000 sheets, and rated as Rank 6 at the time of completion of the image outputting for 20000 sheets.

Ten parts of electron transporting substance (A114), 13.5 parts of crosslinking agent (isocyanate compound having block isocyanate groups (B1:H1(protective group))), 1.5 parts of resin (D1) (in the formula (E-1), $R^{201}$: propyl group) and 0.05 parts of a catalyst (dioctyl tin laurate) were dissolved in a mixed solvent of 100 parts of dimethylacetamide and 100 parts of methyl ethyl ketone. Furthermore, 3.3 parts of a slurry of colloidal silica having a primary average particle diameter of 9 to 15 nm, dispersed in an organic solvent, (trade name: IPA-ST-UP, produced by Nissan Chemical Industries Ltd.) was added as an additive to the solution, and the resultant was stirred for 1 hour to prepare a first intermediate layer coating liquid. The support was dip-coated with the first intermediate layer coating liquid to form a coating film, and the resulting coating film was heated and cured (polymerized) at a temperature of 160° C. for 40 minutes to form a first intermediate layer having a thickness of 0.5 μm. The content of the electron transporting substance based on the total mass of the composition (electron transporting substance, crosslinking agent, resin and silica particle) was 39% by mass.

Comparative Example 1

An electrophotographic photosensitive member was produced and evaluated in the same manner as in Example 1 except that the first intermediate layer was formed as follows. The results are shown in Table 15.

Five parts of an N-methoxymethylated nylon resin (FR-101, produced by Namariichi Co., Ltd.) was mixed with a solvent of 70 parts of methanol and 30 parts of n-butanol to prepare a first intermediate layer coating liquid. The support was dip-coated with the first intermediate layer coating liquid to form a coating film, and the resulting coating film was heated at a temperature of 160° C. for 40 minutes to form a first intermediate layer having a thickness of 0.5 μm.

Comparative Example 2

An electrophotographic photosensitive member was produced and evaluated in the same manner as in Example 1 except that the first intermediate layer was formed as follows. The results are shown in Table 15.

One part of electron transporting substance (A1101) and 5 parts of an N-methoxymethylated nylon resin (FR-101, produced by Namariichi Co., Ltd.) were dissolved in a mixed solvent of 70 parts of methanol and 30 parts of n-butanol to prepare a first intermediate layer coating liquid. The support was dip-coated with the first intermediate layer coating liquid to form a coating film, and the resulting coating film was heated at a temperature of 160° C. for 40 minutes to form a first intermediate layer having a thickness of 0.5 μm. The content of the electron transporting substance based on the total mass of the electron transporting substance and the resin was 17% by mass.

Comparative Example 3

An electrophotographic photosensitive member was produced and evaluated in the same manner as in Comparative Example 2 except that with respect to the second intermediate layer, the type of the second intermediate layer coating liquid was changed as shown in Table 15. The results are shown in Table 15.

Comparative Example 4

An electrophotographic photosensitive member was produced and evaluated in the same manner as in Comparative Example 3 except that with respect to the first intermediate layer, the content of the electron transporting substance was changed as shown in Table 15.

The results are shown in Table 15.

TABLE 14

| | First intermediate layer | | | | | | | | Second intermediate layer | | | | Evaluation | |
|---|---|---|---|---|---|---|---|---|---|---|---|---|---|---|
| | Electron transporting substance | | Crosslinking agent | | Resin D | | Thick- | Content of electron transporting substance | Type of second intermediate layer | Thick- | Content of metal oxide particle | Electron transporting substance/ Metal | | |
| Example | Type | Part (s) | Type | Part (s) | Type | Part (s) | ness (μm) | (% by mass) | coating liquid | ness (μm) | (% by mass) | oxide particle | 10000 sheets | 20000 sheets |
| Example 1 | A114 | 9 | B1:H1 | 16 | — | — | 0.5 | 36 | 1 | 3.5 | 75 | 0.48 | 5 | 5 |
| Example 2 | A114 | 9 | B1:H1 | 16 | — | — | 0.3 | 36 | 1 | 3.5 | 75 | 0.48 | 5 | 5 |
| Example 3 | A114 | 9 | B1:H1 | 16 | — | — | 0.3 | 36 | 1 | 2.5 | 75 | 0.48 | 5 | 5 |
| Example 4 | A114 | 9 | B1:H1 | 16 | — | — | 0.3 | 36 | 1 | 5 | 75 | 0.48 | 6 | 5 |
| Example 5 | A117 | 9 | B1:H1 | 16 | — | — | 0.3 | 36 | 1 | 3.5 | 75 | 0.48 | 6 | 5 |
| Example 6 | A106 | 9 | B1:H1 | 16 | — | — | 0.5 | 36 | 1 | 3.5 | 75 | 0.48 | 6 | 5 |
| Example 7 | A109 | 9 | B1:H1 | 16 | — | — | 0.8 | 36 | 1 | 3.5 | 75 | 0.48 | 5 | 5 |
| Example 8 | A201 | 9 | B1:H1 | 16 | — | — | 0.5 | 36 | 1 | 3.5 | 75 | 0.48 | 5 | 5 |
| Example 9 | A304 | 9 | B1:H1 | 16 | — | — | 0.5 | 36 | 1 | 3.5 | 75 | 0.48 | 5 | 5 |
| Example 10 | A403 | 9 | B1:H1 | 16 | — | — | 0.5 | 36 | 1 | 3.5 | 75 | 0.48 | 5 | 5 |
| Example 11 | A503 | 9 | B1:H1 | 16 | — | — | 0.5 | 36 | 1 | 3.5 | 75 | 0.48 | 5 | 5 |
| Example 12 | A605 | 9 | B1:H1 | 16 | — | — | 0.5 | 36 | 1 | 3.5 | 75 | 0.48 | 5 | 5 |
| Example 13 | A705 | 9 | B1:H1 | 16 | — | — | 0.5 | 36 | 1 | 3.5 | 75 | 0.48 | 5 | 5 |
| Example 14 | A805 | 9 | B1:H1 | 16 | — | — | 0.5 | 36 | 1 | 3.5 | 75 | 0.48 | 5 | 5 |
| Example 15 | A904 | 9 | B1:H1 | 16 | — | — | 0.8 | 36 | 1 | 3.5 | 75 | 0.48 | 5 | 5 |
| Example 16 | A1001 | 9 | B1:H1 | 16 | — | — | 0.5 | 36 | 1 | 3.5 | 75 | 0.48 | 5 | 5 |
| Example 17 | A1101 | 9 | B1:H1 | 16 | — | — | 0.5 | 36 | 1 | 3.5 | 75 | 0.48 | 6 | 5 |
| Example 18 | A114 | 8 | B1:H1 | 17 | — | — | 0.5 | 32 | 1 | 3.5 | 75 | 0.43 | 5 | 5 |
| Example 19 | A1101 | 8 | B1:H1 | 17 | — | — | 0.3 | 32 | 1 | 3.5 | 75 | 0.43 | 5 | 5 |
| Example 20 | A114 | 7 | B1:H1 | 18 | — | — | 0.5 | 28 | 1 | 3.5 | 75 | 0.37 | 5 | 4 |
| Example 21 | A117 | 7 | B1:H1 | 18 | — | — | 0.5 | 28 | 1 | 3.5 | 75 | 0.37 | 5 | 4 |
| Example 22 | A1101 | 7 | B1:H1 | 18 | — | — | 0.5 | 28 | 1 | 3.5 | 75 | 0.37 | 5 | 4 |
| Example 23 | A114 | 7 | B1:H1 | 18 | — | — | 0.5 | 28 | 2 | 3.5 | 70 | 0.40 | 5 | 5 |
| Example 24 | A114 | 9 | B1:H1 | 16 | — | — | 0.5 | 36 | 4 | 2.5 | 58 | 0.62 | 5 | 5 |
| Example 25 | A1101 | 9 | B1:H1 | 16 | — | — | 0.5 | 36 | 4 | 3.5 | 58 | 0.62 | 5 | 5 |
| Example 26 | A106 | 9 | B1:H1 | 16 | — | — | 0.5 | 36 | 3 | 3.5 | 65 | 0.55 | 6 | 5 |
| Example 27 | A109 | 9 | B1:H5 | 16 | — | — | 0.5 | 36 | 3 | 3.5 | 65 | 0.55 | 6 | 5 |
| Example 28 | A109 | 9 | B7:H1 | 16 | — | — | 0.5 | 36 | 3 | 3.5 | 65 | 0.55 | 6 | 5 |
| Example 29 | A114 | 9 | C1-3 | 16 | — | — | 0.5 | 36 | 1 | 3.5 | 75 | 0.48 | 5 | 5 |
| Example 30 | A117 | 9 | C1-3 | 16 | — | — | 0.5 | 36 | 1 | 3.5 | 75 | 0.48 | 5 | 5 |
| Example 31 | A106 | 9 | C1-3 | 16 | — | — | 0.5 | 36 | 1 | 3.5 | 75 | 0.48 | 5 | 5 |
| Example 32 | A109 | 9 | C1-3 | 16 | — | — | 0.5 | 36 | 1 | 3.5 | 75 | 0.48 | 5 | 5 |
| Example 33 | A1101 | 9 | C1-3 | 16 | — | — | 0.5 | 36 | 1 | 3.5 | 75 | 0.48 | 5 | 5 |
| Example 34 | A114 | 7 | C1-3 | 18 | — | — | 0.5 | 28 | 1 | 3.5 | 75 | 0.37 | 5 | 4 |
| Example 35 | A114 | 9 | C1-3 | 16 | — | — | 0.5 | 36 | 4 | 3.5 | 58 | 0.62 | 5 | 5 |
| Example 36 | A1101 | 9 | B1:H1 | 16 | — | — | 0.5 | 36 | 6 | 3.5 | 75 | 0.48 | 5 | 5 |
| Example 37 | A1101 | 9 | B1:H1 | 16 | — | — | 0.5 | 36 | 7 | 3.5 | 65 | 0.55 | 5 | 4 |
| Example 38 | A1101 | 9 | C1-3 | 16 | — | — | 0.5 | 36 | 6 | 3.5 | 75 | 0.48 | 5 | 5 |
| Example 39 | A1101 | 9 | B1:H1 | 16 | — | — | 0.5 | 36 | 5 | 3.5 | 75 | 0.48 | 5 | 5 |
| Example 40 | A114 | 9 | B1:H1 | 16 | — | — | 0.5 | 36 | 5 | 3.5 | 75 | 0.48 | 5 | 5 |
| Example 41 | A117 | 9 | C1-3 | 16 | — | — | 0.5 | 36 | 5 | 3.5 | 75 | 0.48 | 5 | 5 |
| Example 42 | A1101 | 9 | B1:H1 | 16 | — | — | 0.5 | 36 | 8 | 3.5 | 75 | 0.48 | 5 | 5 |
| Example 43 | A1101 | 9 | B1:H1 | 16 | — | — | 0.5 | 36 | 9 | 3.5 | 75 | 0.48 | 5 | 4 |
| Example 44 | A114 | 8 | B1:H1 | 13.7 | D1 | 3.3 | 0.5 | 32 | 1 | 3.5 | 75 | 0.43 | 6 | 5 |
| Example 45 | A101 | 10 | B1:H1 | 13.5 | D1 | 1.5 | 0.5 | 40 | 1 | 3.5 | 75 | 0.53 | 6 | 6 |
| Example 46 | A114 | 10 | B1:H1 | 13.5 | D1 | 1.5 | 0.5 | 40 | 1 | 3.5 | 75 | 0.53 | 6 | 6 |
| Example 47 | A117 | 10 | B1:H1 | 13.5 | D1 | 1.5 | 0.8 | 40 | 1 | 3.5 | 75 | 0.53 | 6 | 6 |
| Example 48 | A109 | 10 | B1:H1 | 13.5 | D1 | 1.5 | 0.5 | 40 | 1 | 3.5 | 75 | 0.53 | 6 | 6 |
| Example 49 | A1101 | 10 | B1:H1 | 13.5 | D1 | 1.5 | 0.5 | 40 | 1 | 3.5 | 75 | 0.53 | 6 | 6 |
| Example 50 | A114 | 10 | B1:H1 | 13.5 | D1 | 1.5 | 0.5 | 40 | 3 | 3.5 | 65 | 0.62 | 6 | 6 |
| Example 51 | A201 | 11.3 | B1:H1 | 12.7 | D1 | 1 | 0.8 | 45 | 1 | 3.5 | 75 | 0.60 | 6 | 6 |
| Example 52 | A304 | 11.3 | B1:H1 | 12.7 | D1 | 1 | 0.5 | 45 | 1 | 3.5 | 75 | 0.60 | 6 | 6 |
| Example 53 | A403 | 11.3 | B1:H1 | 12.7 | D1 | 1 | 0.5 | 45 | 1 | 3.5 | 75 | 0.60 | 6 | 6 |
| Example 54 | A503 | 11.3 | B1:H1 | 12.7 | D1 | 1 | 0.5 | 45 | 1 | 3.5 | 75 | 0.60 | 6 | 6 |
| Example 55 | A605 | 11.3 | B1:H1 | 12.7 | D1 | 1 | 0.5 | 45 | 1 | 3.5 | 75 | 0.60 | 6 | 6 |
| Example 56 | A705 | 11.3 | B1:H1 | 12.7 | D1 | 1 | 0.5 | 45 | 1 | 3.5 | 75 | 0.60 | 6 | 6 |
| Example 57 | A805 | 11.3 | B1:H1 | 12.7 | D1 | 1 | 0.5 | 45 | 1 | 3.5 | 75 | 0.60 | 6 | 6 |
| Example 58 | A904 | 11.3 | B1:H1 | 12.7 | D1 | 1 | 0.5 | 45 | 1 | 3.5 | 75 | 0.60 | 6 | 6 |
| Example 59 | A1001 | 11.3 | B1:H1 | 12.7 | D1 | 1 | 0.5 | 45 | 1 | 3.5 | 75 | 0.60 | 6 | 6 |
| Example 60 | A101 | 7 | B1:H1 | 13.8 | D1 | 4.2 | 0.5 | 28 | 1 | 3.5 | 75 | 0.37 | 5 | 4 |
| Example 61 | A304 | 7 | B1:H1 | 13.8 | D1 | 4.2 | 0.5 | 28 | 1 | 3.5 | 75 | 0.37 | 5 | 4 |
| Example 62 | A114 | 9 | B1:H1 | 13.6 | D1 | 2.4 | 0.5 | 36 | 4 | 3.5 | 58 | 0.62 | 5 | 5 |
| Example 63 | A114 | 11 | C1-3 | 8.7 | D1 | 5 | 0.5 | 45 | 1 | 3.5 | 75 | 0.60 | 6 | 6 |
| Example 64 | A705 | 11 | C1-3 | 8.7 | D1 | 5 | 1 | 45 | 1 | 3.5 | 75 | 0.60 | 6 | 6 |
| Example 65 | A114 | 11 | C1-3 | 8.7 | D21 | 5 | 0.5 | 45 | 1 | 3.5 | 75 | 0.60 | 6 | 6 |
| Example 66 | A114 | 14.7 | C1-3 | 8 | D21 | 2.2 | 0.5 | 59 | 1 | 3.5 | 75 | 0.79 | 6 | 6 |

TABLE 14-continued

| | First intermediate layer | | | | | | | | Second intermediate layer | | | | | |
|---|---|---|---|---|---|---|---|---|---|---|---|---|---|---|
| | Electron transporting substance | | Crosslinking agent | | Resin D | | Thick- | Content of electron transporting substance | Type of second intermediate layer | Thick- | Content of metal oxide particle | Electron transporting substance/ Metal | Evaluation | |
| Example | Type | Part (s) | Type | Part (s) | Type | Part (s) | ness (μm) | (% by mass) | coating liquid | ness (μm) | (% by mass) | oxide particle | 10000 sheets | 20000 sheets |
| Example 67 | A114 | 14.7 | C1-7 | 8 | D21 | 2.2 | 0.5 | 59 | 1 | 3.5 | 75 | 0.79 | 6 | 6 |
| Example 68 | A114 | 14.7 | C1-3 | 8 | D21 | 2.2 | 0.5 | 59 | 3 | 3.5 | 65 | 0.91 | 6 | 6 |

TABLE 15

| | First intermediate layer | | | | | | | | Second intermediate layer | | | | | |
|---|---|---|---|---|---|---|---|---|---|---|---|---|---|---|
| | Electron transporting substance | | Crosslinking agent | | Resin D | | Thick- | Content of electron transporting substance | Type of second intermediate layer | Thick- | Content of metal oxide particle | Electron transporting substance/ Metal | Evaluation | |
| Comparative Example | Type | Part (s) | Type | Part (s) | Type | Part (s) | ness (μm) | (% by mass) | coating liquid | ness (μm) | (% by mass) | oxide particle | 10000 sheets | 20000 sheets |
| Comparative Example 1 | — | — | — | — | N-METHOXY-METHYL-ATED NYLON | 5 | 0.5 | — | 1 | 3.5 | 75 | 0 | 3 | 1 |
| Comparative Example 2 | A1101 | 1 | — | — | N-METHOXY-METHYL-ATED NYLON | 5 | 0.5 | 17 | 1 | 3.5 | 75 | 0.23 | 3 | 2 |
| Comparative Example 3 | A1101 | 1 | — | — | N-METHOXY-METHYL-ATED NYLON | 5 | 0.5 | 17 | 5 | 3.5 | 75 | 0.23 | 3 | 2 |
| Comparative Example 4 | A1101 | 2.4 | — | — | N-METHOXY-METHYL-ATED NYLON | 5 | 0.5 | 32 | 5 | 3.5 | 75 | 0.43 | 3 | 2 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-270563, filed Dec. 26, 2013, and Japanese Patent Application No. 2014-247192, filed Dec. 5, 2014, which are hereby incorporated by reference herein in their entirety.

What is claimed is:

1. An electrophotographic photosensitive member comprising:

an electrically conductive support;

a first intermediate layer formed directly on the electrically conductive support, said first intermediate layer comprising a silica particle, and a polymerized product of a composition comprising an electron transporting substance having a polymerizable functional group and a crosslinking agent;

a second intermediate layer on the first intermediate layer, said second intermediate layer comprising a binder resin and a metal oxide particle;

a charge generating layer on the second intermediate layer; and a hole transporting layer on the charge generating layer, wherein the content (% by mass) of the electron transporting substance in the composition of the first intermediate layer is 0.4 to 1 time the content (% by mass) of the metal oxide particle based on the total mass of the second intermediate layer.

2. The electrophotographic photosensitive member according to claim 1, wherein a content of the electron transporting substance in the composition of the first intermediate layer is 30% by mass or more based on the total mass of the composition.

3. The electrophotographic photosensitive member according to claim 1, wherein a content of the metal oxide particle in the second intermediate layer is 50% to 75% by mass based on the total mass of the second intermediate layer.

4. The electrophotographic photosensitive member according to claim 1, wherein the polymerizable functional group of the electron transporting substance is a hydroxy group, a thiol group, an amino group, a carboxyl group or a methoxy group.

5. The electrophotographic photosensitive member according to claim 1, wherein the crosslinking agent is an isocyanate compound having an isocyanate group or a block isocyanate group, or an amine compound having an N-methylol group or an alkyletherified N-methylol group.

6. The electrophotographic photosensitive member according to claim 1, wherein the composition in the first intermediate layer further comprises a resin having a polymerizable functional group.

7. The electrophotographic photosensitive member according to claim 6, wherein the polymerizable functional group of the resin is a hydroxy group, a thiol group, an amino group, a carboxyl group or a methoxy group.

8. A process cartridge integrally supporting the electrophotographic photosensitive member according to claim 1 and at least one unit selected from the group consisting of a charging unit, a developing unit and a cleaning unit, the process cartridge being attachable to and detachable from a main body of an electrophotographic apparatus.

9. An electrophotographic apparatus comprising the electrophotographic photosensitive member according to claim 1, an exposing unit, a charging unit, a developing unit, and a transfer unit.

10. The electrophotographic photosensitive member according to claim 1, wherein the crosslinking agent is an amine compound having an N-methylol group or an alkyletherified N-methylol group.

11. The electrophotographic photosensitive member according to claim 1, wherein the content (% by mass) of the electron transporting substance in the composition of the first intermediate layer is 0.4 to 0.79 times the content (% by mass) of the metal oxide particle based on the total mass of the second intermediate layer.

* * * * *